US009580209B2

(12) United States Patent
Blume et al.

(10) Patent No.: US 9,580,209 B2
(45) Date of Patent: Feb. 28, 2017

(54) ELECTRONIC TABLET CASE WITH INTERNAL EASEL

(71) Applicants: Megan Blume, Springboro, OH (US); Taryn Yost, Middletown, OH (US); Kathryn Hayes, Indianapolis, IN (US); Thomas J. Africa, Lebanon, OH (US); Ross Worden, Gahanna, OH (US)

(72) Inventors: Megan Blume, Springboro, OH (US); Taryn Yost, Middletown, OH (US); Kathryn Hayes, Indianapolis, IN (US); Thomas J. Africa, Lebanon, OH (US); Ross Worden, Gahanna, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 1028 days.

(21) Appl. No.: 13/766,278

(22) Filed: Feb. 13, 2013

(65) Prior Publication Data

US 2013/0213825 A1 Aug. 22, 2013

Related U.S. Application Data

(60) Provisional application No. 61/598,638, filed on Feb. 14, 2012.

(51) Int. Cl.
*B65D 25/20* (2006.01)
*A45C 11/00* (2006.01)

(52) U.S. Cl.
CPC ..... *B65D 25/20* (2013.01); *A45C 11/00* (2013.01); *A45C 2011/003* (2013.01); *A45C 2200/15* (2013.01)

(58) Field of Classification Search
CPC ..... B42F 3/06; B42F 7/02; B42F 7/04; B42F 7/06; B42F 13/0033; B42F 13/40; A45C 11/00; A45C 11/24; A45C 11/34; A45C 13/02; B42D 3/06; B42D 5/00; B42D 5/005; B42D 9/00; B42P 2241/02; B42P 2241/04; B42P 2241/06; B42P 2241/12; B42P 2241/16; B65D 25/20

(Continued)

(56) References Cited

U.S. PATENT DOCUMENTS 4,544,123 A 10/1985 Peacock
5,029,784 A 7/1991 Blahout (Continued)

FOREIGN PATENT DOCUMENTS

GB 672300 5/1952
JP 11-103922 4/1999

(Continued)

OTHER PUBLICATIONS

International Search Report and Written Opinion. PCT/US2013/025888. Jun. 11, 2013.

(Continued)

*Primary Examiner* — J. Gregory Pickett
*Assistant Examiner* — Brijesh V. Patel
(74) *Attorney, Agent, or Firm* — Thompson Hine LLP

(57) ABSTRACT

A storage component including a cover and an easel coupled to the cover. The easel includes a first portion and a second portion pivotally coupled together, wherein the easel is movable between a substantially flat configuration wherein the first and second portions are generally flat and coplanar, and a propped configuration wherein the first and second portions are arranged in a non-coplanar configuration and the first portion is oriented at an angle relative to the cover. The first portion of the easel in the propped configuration is configured to support an item thereon for display.

22 Claims, 26 Drawing Sheets

(58) Field of Classification Search
USPC ..... 206/45.24, 214, 232, 305, 320, 472–474,206/476, 482, 487, 524; 281/9, 14, 15.1, 29, 31, 281/33, 37, 44, 50–51; 402/3, 14, 70, 73, 80 R; 190/109
See application file for complete search history.

(56) References Cited

U.S. PATENT DOCUMENTS

| | | | | |
|---|---|---|---|---|
| 5,377,794 | A | 1/1995 | Book | |
| 5,445,251 | A * | 8/1995 | Redwood | A45C 11/34 190/109 |
| 5,607,054 | A | 3/1997 | Hollingsworth | |
| 5,717,566 | A | 2/1998 | Tao | |
| 5,877,896 | A | 3/1999 | Gremban | |
| 5,988,823 | A | 11/1999 | Wong | |
| 6,024,508 | A * | 2/2000 | Lippeth | B42F 13/0033 281/31 |
| 6,039,419 | A | 3/2000 | Brown et al. | |
| 6,305,652 | B1 | 10/2001 | Borke et al. | |
| 6,547,283 | B1 * | 4/2003 | Moor | B42F 13/40 150/112 |
| 7,178,778 | B2 | 2/2007 | Lee | |
| 7,281,877 | B1 * | 10/2007 | Lederer | A45C 13/02 281/31 |
| 7,545,634 | B2 | 6/2009 | Simonian et al. | |
| 8,230,992 | B2 | 7/2012 | Law et al. | |
| 8,607,976 | B2 | 12/2013 | Wu et al. | |
| 8,746,449 | B2 | 6/2014 | Gallagher et al. | |
| 2002/0100398 | A1 | 8/2002 | Santini | |
| 2002/0162935 | A1 | 11/2002 | Hardy | |
| 2007/0172309 | A1 * | 7/2007 | Witter | B42F 7/06 402/73 |
| 2008/0237432 | A1 | 10/2008 | Patterson | |
| 2009/0159763 | A1 * | 6/2009 | Kim | F16M 13/00 248/174 |
| 2010/0122924 | A1 | 5/2010 | Andrews | |
| 2011/0297564 | A1 | 12/2011 | Kim et al. | |
| 2011/0297581 | A1 | 12/2011 | Angel | |
| 2013/0213825 | A1 | 8/2013 | Blume et al. | |

FOREIGN PATENT DOCUMENTS

| | | |
|---|---|---|
| KR | 10-0992436 | 11/2010 |
| WO | 01/07994 | 2/2001 |
| WO | 2005/020752 | 3/2005 |

OTHER PUBLICATIONS

FolioTrio Mobile Workstation for new iPad® and iPad® 2 by Kensington. Jan. 2012.

* cited by examiner 14B
14B
324
320
310
319
314
200
338
339
336
333
x
324
310
338
314
320
200
102
130
x
200
310
110
150 w1
θ
200
310
314
319
320
324
333
336
338
339
15B 17B
200
324
320
315
310
326
347
316
336
338
339
333
334
319
314
w1
102
130
331
150
110

ELECTRONIC TABLET CASE WITH INTERNAL EASEL

This application claims priority to U.S. Provisional Patent Application 61/598,638, filed on Feb. 14, 2012, and entitled Electronic Tablet Case with Internal Easel, the entire contents of which are incorporated by reference herein.

TECHNICAL FIELD

This disclosure is directed to a case for an electronic tablet and, more particularly, to a case with an internal easel to support the electronic tablet in multiple orientations.

BACKGROUND

The use of portable electronic devices, including smart phones, laptop computers, tablet computers, and the like, has become commonplace. In contrast to previous devices such as flip phones or laptop computers that may have a hinged cover to protect the screen when not in use, electronic tablet computers may have an exposed screen. When in use, an electronic tablet computer may be placed flat upon a table or desk, or upon the user's lap. However, it is often convenient to place the electronic tablet at an angle for easier viewing.

SUMMARY

In one embodiment the present invention is a case with an internal easel configured to support an electronic device in multiple orientations. More particularly, in one embodiment the invention is a storage component including a cover and an easel coupled to the cover. The easel includes a first portion and a second portion pivotally coupled together, wherein the easel is movable between a substantially flat configuration wherein the first and second portions are generally flat and coplanar, and a propped configuration wherein the first and second portions are arranged in a non-coplanar configuration and the first portion is oriented at an angle relative to the cover. The first portion of the easel in the propped configuration is configured to support an item thereon for display.

DETAILED DESCRIPTION

Figure 1:
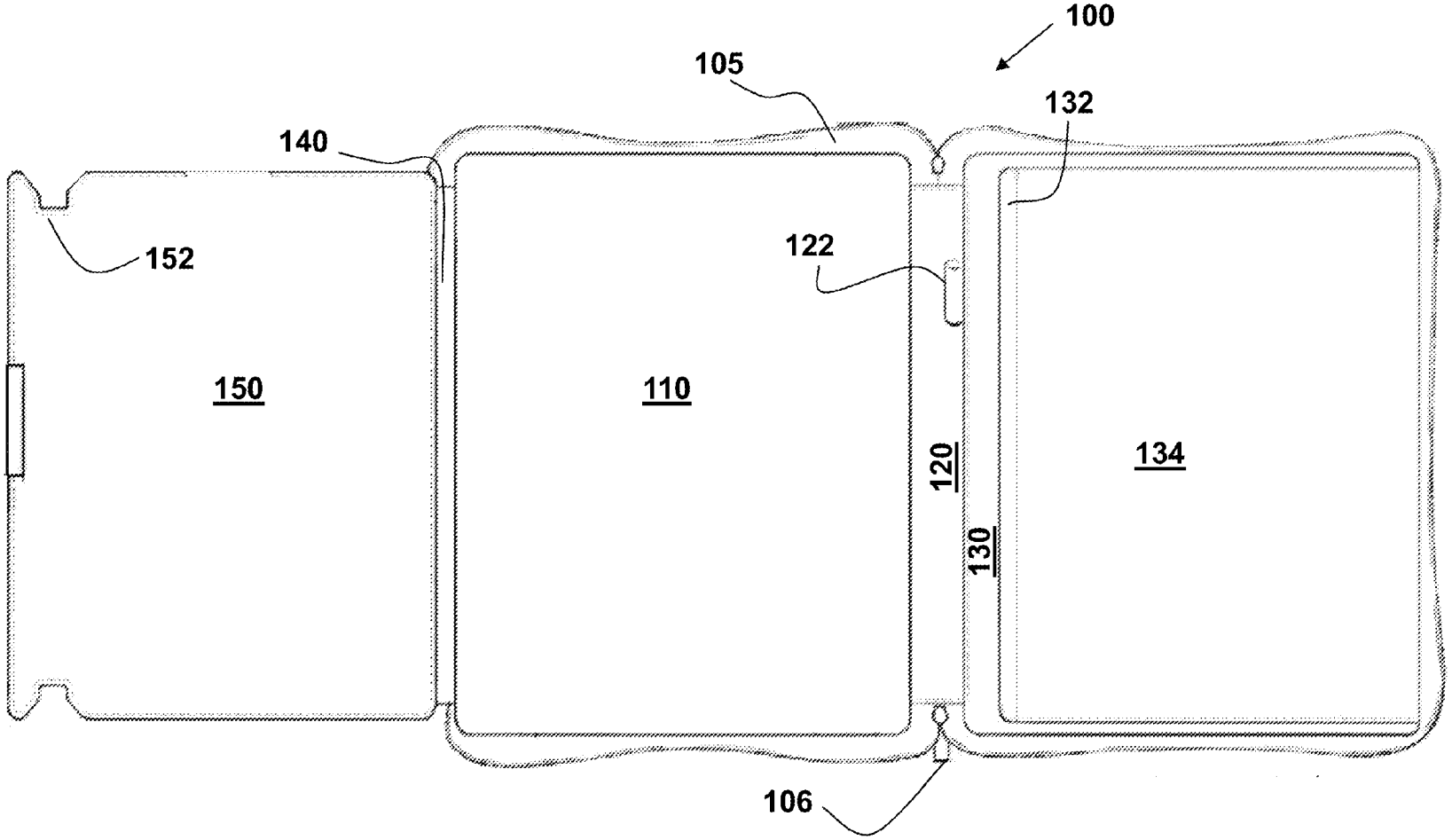
FIG. 1 is a plan view of the inside of one embodiment of a case.

This application is directed to a case which can receive and store an electronic device such as an electronic tablet, which includes tablet computers. The electronic tablet can take any of a wide variety of shapes and forms, but in one embodiment includes a processor and a touch-sensitive or pressure-sensitive screen which a user can manually manipulate to provide inputs to, and from which the user can receive outputs. The electronic tablet can be generally flat and planar, and rectangular in top view, and in one case lacks an external keyboard. The electronic tablet can include e-readers and the like and may be, for example, an iPad® device sold by Apple Computer Corporation, a Kindle® device sold by Amazon.com, Inc., a Galaxy Tab™ device sold by Samsung Electronics Co., Ltd., a Nook® device sold by Barnes & Noble, Inc., or a Nexus® device sold by Google Inc. The case may also be configured to hold a (paper) tablet, notebook, or other display item. A support is provided for the electronic tablet, in the form of an easel capable of propping up the electronic tablet in multiple orientations and in multiple planes.

As various embodiments of the case are described, reference will be made to FIGS. 1-26. Certain parts of the case are denoted by reference numerals. Where there is more than one of the same feature, generally only one will be denoted by a reference numeral. Where assembly steps are described, these steps are exemplary and are not to be limiting as to the sequence of operations that can be used to assemble the case. Also, directions such as up, down, top, bottom, front, back, etc. are used herein for convenience and are not meant to be limiting. The word "panel" will often be used to describe a generally flat, planar piece or portion of sheet material from which the case is made.

As used in this written description and the claims to follow, when the word "substantially" is used to modify a term with a precise mathematical definition such as "planar," "coplanar," "perpendicular," "parallel," "equal," "pentagonal," "trapezoidal," "flat," or the like, the modified term should be interpreted to include variations that differ in only minor respects from the precise mathematical definition, but nonetheless impress upon one skilled in the art the concept at issue. For instance, two lines may be "substantially perpendicular" if the two lines are within a few degrees of perpendicular. The term "generally" is similarly defined as a modifier, but with a slightly larger tolerance, as will be appreciated by one skilled in the art.

FIG. 1 shows a front plan view of one embodiment of the case 100. The case 100 may include a first panel or front cover 110, and a second panel or back cover 130 joined by a spine or cover fold line/area 120. The front cover 110 and back cover 130 may be pivotally coupled together, either directly (in which case the spine 120 can be omitted) or via the spine 120. A perimeter of the case 100 may include a casing 105, which can be made from a variety of materials, including plastic, polymers, fabric, leather, or the like. The casing 105 can surround and/or form part of the outer surface of the covers 110, 130 and spine 120. The case 100 may include a zipper 106 for releasably coupling the covers 110, 130 and closing the case 100. The case 100 may also be closed and held shut by a closure device such as a clasp 104 (see FIG. 21) that may include a snap closure, hook-and-loop closure, magnetic closure, or other closure device.

Figure 3:
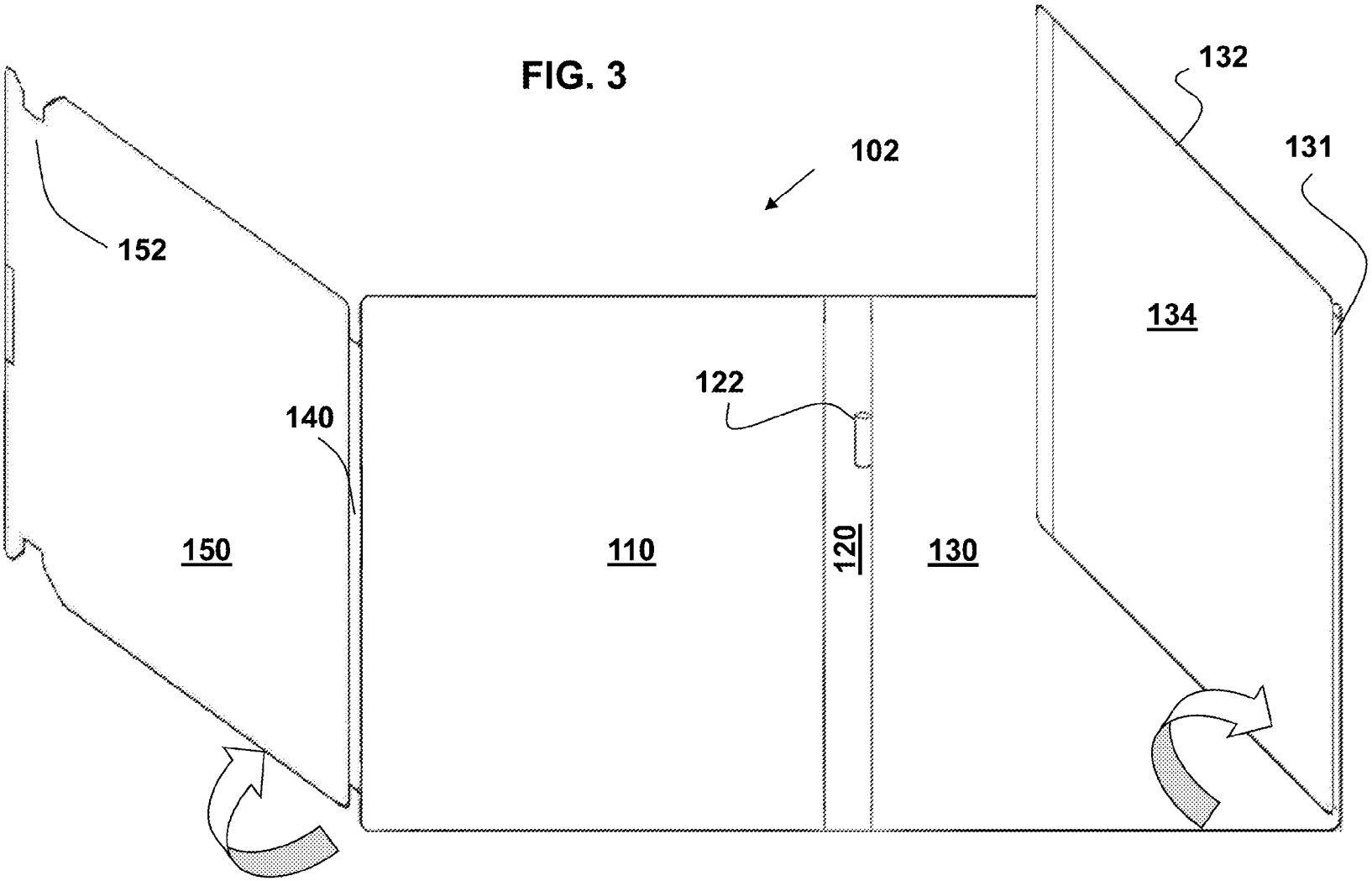
FIG. 3 is a perspective view of the inside of the case of FIG. 2 with certain panels folded upward/inward.

The case 100 may include a back flap 132 pivotally attached to back cover 130 through a hinge 131 (see also FIG. 3). The back flap 132 may include a back pocket 134 thereon. The case 100 may also include a front flap 150 pivotally attached to front cover 110 through a hinge 140. The hinge 140 may have a width approximately equal to or greater than the thickness of the contents (such as an electronic tablet 201) to be received in the case 100. The front flap 150 may have a notch 152 at its top and/or bottom edges. Each notch 152 can be configured to receive therein an accessory such as a wire or cable for a USB connector, earphones, power cord, or the like, which may be wrapped around front flap 150 and within the notches 152. One or more holders 122 may be provided on the case 100, and holders 122 can take the form of loops to hold pens, pencils, and the like.

Figure 2:
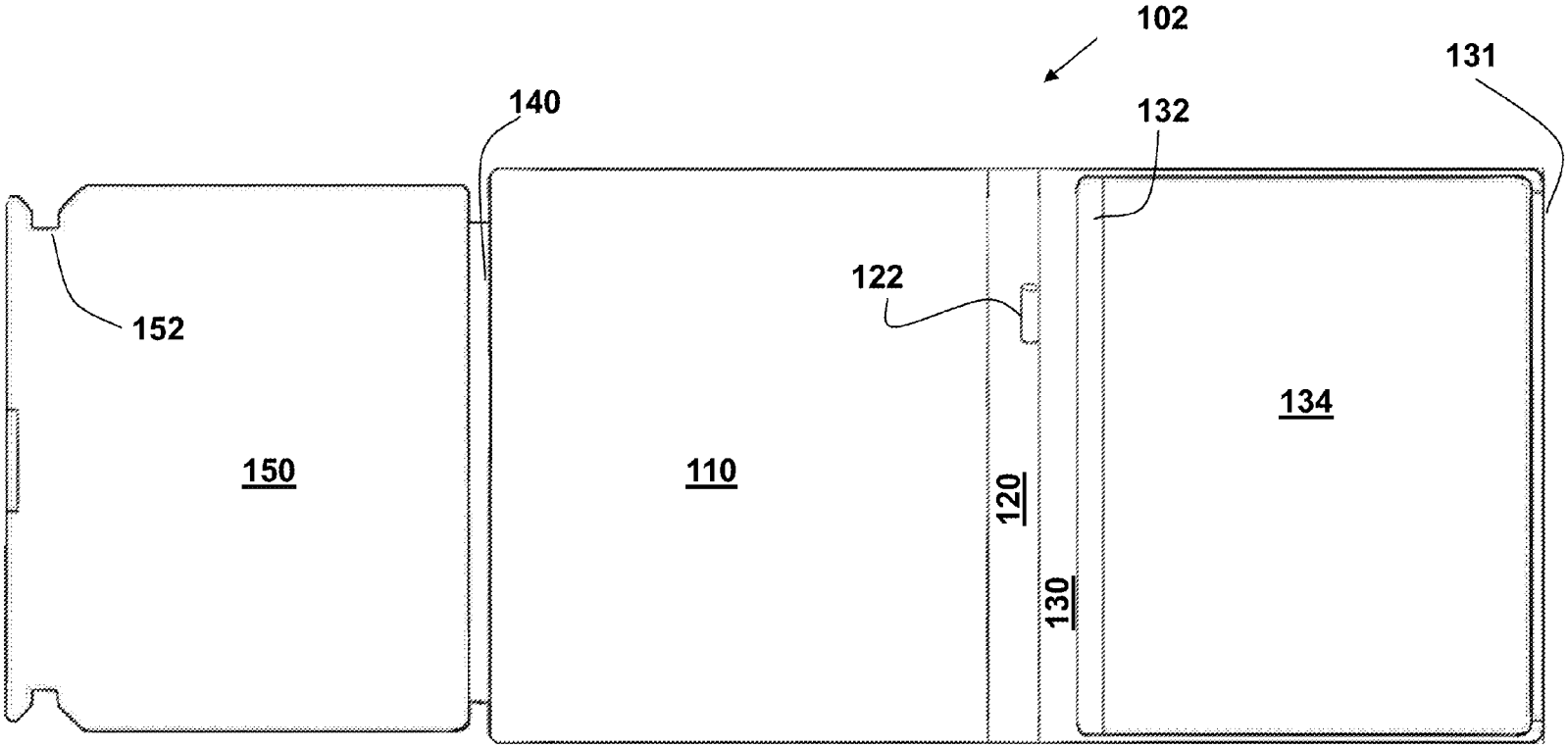
FIG. 2 is a plan view of the inside of an alternative case.

FIG. 2 shows a front plan view of another case 102, which is similar to the case 100 of FIG. 1, except that case 102 lacks the casing 105.

FIG. 3 shows a perspective view of case 102 of FIG. 2, illustrating how front flap 150 may be folded inward about hinge 140, to overlay the front cover 110 or contents that may be located on the front cover 110. Likewise, FIG. 3 illustrates how back flap 132 may be folded or pivoted inward about hinge 131. The case 100 shown in FIG. 1 may be manipulated in a similar fashion.

Figure 4:
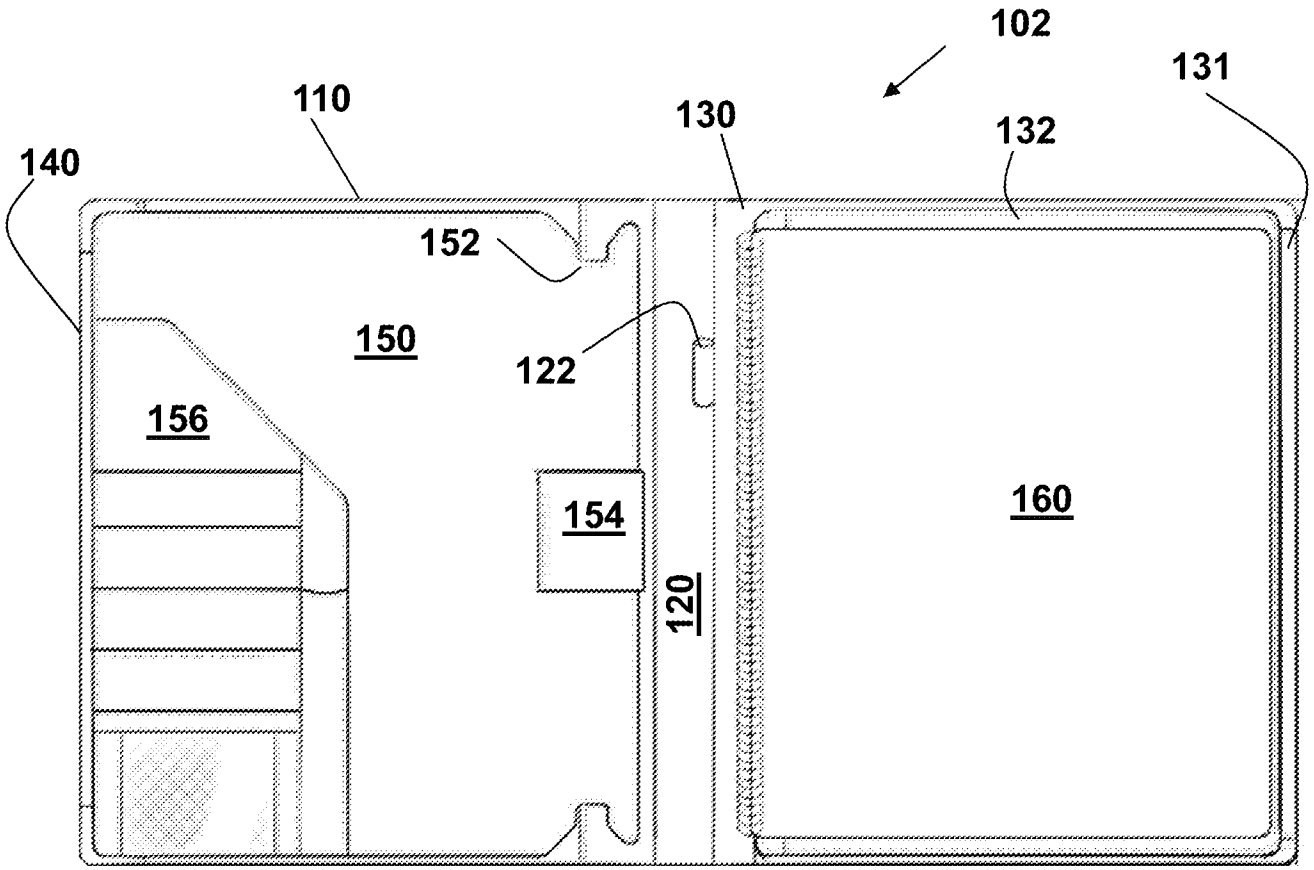
FIG. 4 is a plan view of the inside of the case of FIG. 2, with one panel folded completed inward and another panel folded completely inward and a notebook positioned thereon.

FIG. 4 shows a plan view of case 102, with the front flap 150 folded inward to overlay front cover 110. The outer face of front flap 150, now visible, may have one or more pockets 156 attached thereto. The front flap 150 may also have a front flap handle 154, which can take the form of a strap or loop of material that may be grasped by a user to assist in pivoting the front flap 150 about hinge 140. If provided as a loop, front flap handle 154 may also serve to hold items such as a ruler, a comb, etc., in a fashion similar to holder 122.

FIG. 4 also shows a notebook 160 supported on the back flap 132, for example by inserting a cover, pages, or cover and pages of the notebook 160, into pocket 134 (shown in FIG. 3) of back flap 132 with an opening substantially parallel to spine 120. Pocket 134 may, however, be differently shaped or include openings in other orientations. It should be noted that when the notebook 160 is thus coupled to the back flap 132, the back flap 132 may be raised as shown in FIG. 3 to permit turning a subset of pages and/or covers "counterclockwise" and under back flap 132, so that those subset pages and/or cover do not overlie the front cover 110 or any display item 201 attached thereto. The back flap 132 may also be able to be folded completely outward to the right of FIG. 3, underlying the back panel 130.

Figure 5:
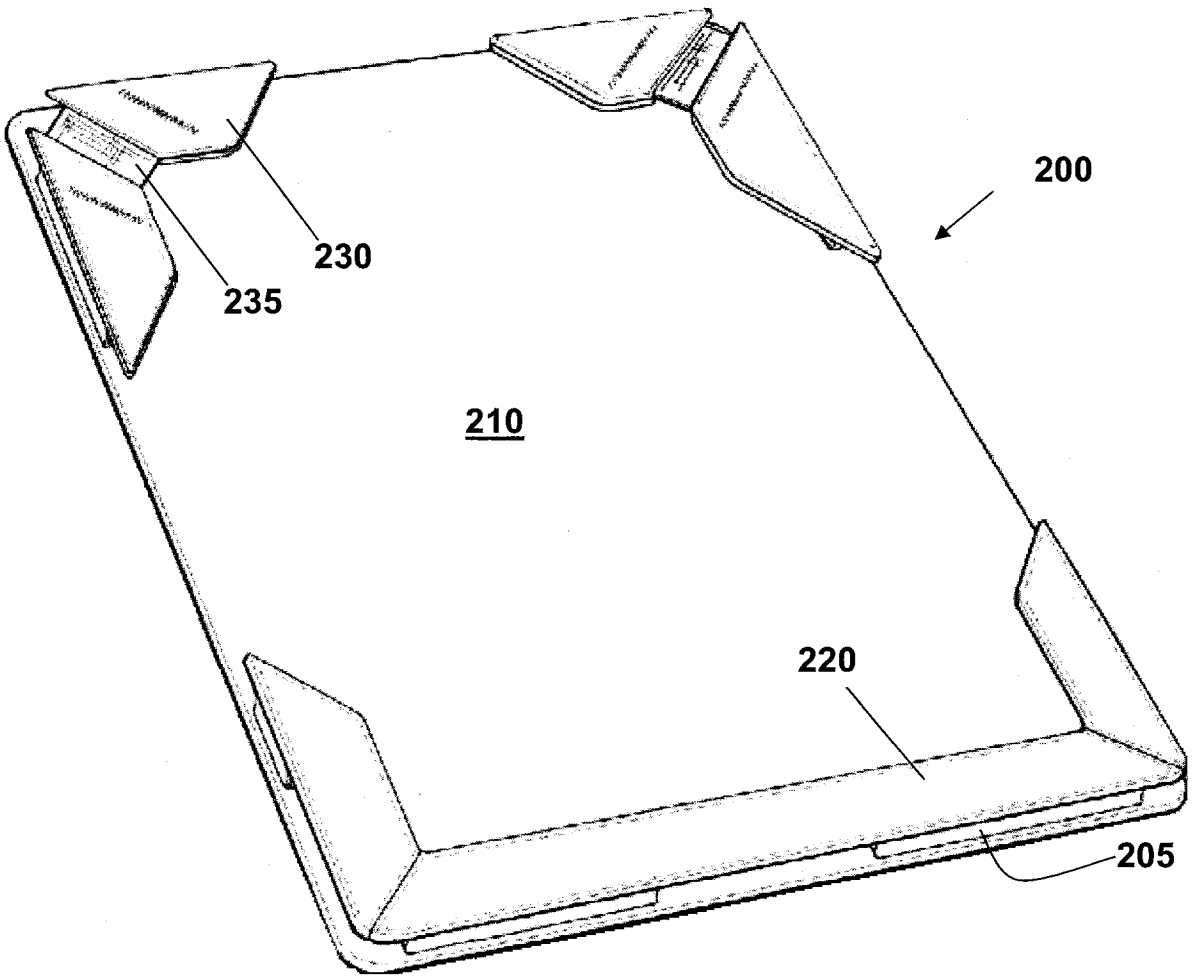
FIGS. 5 and 6 are perspective views of frames for use with the notebook.
Figure 6:
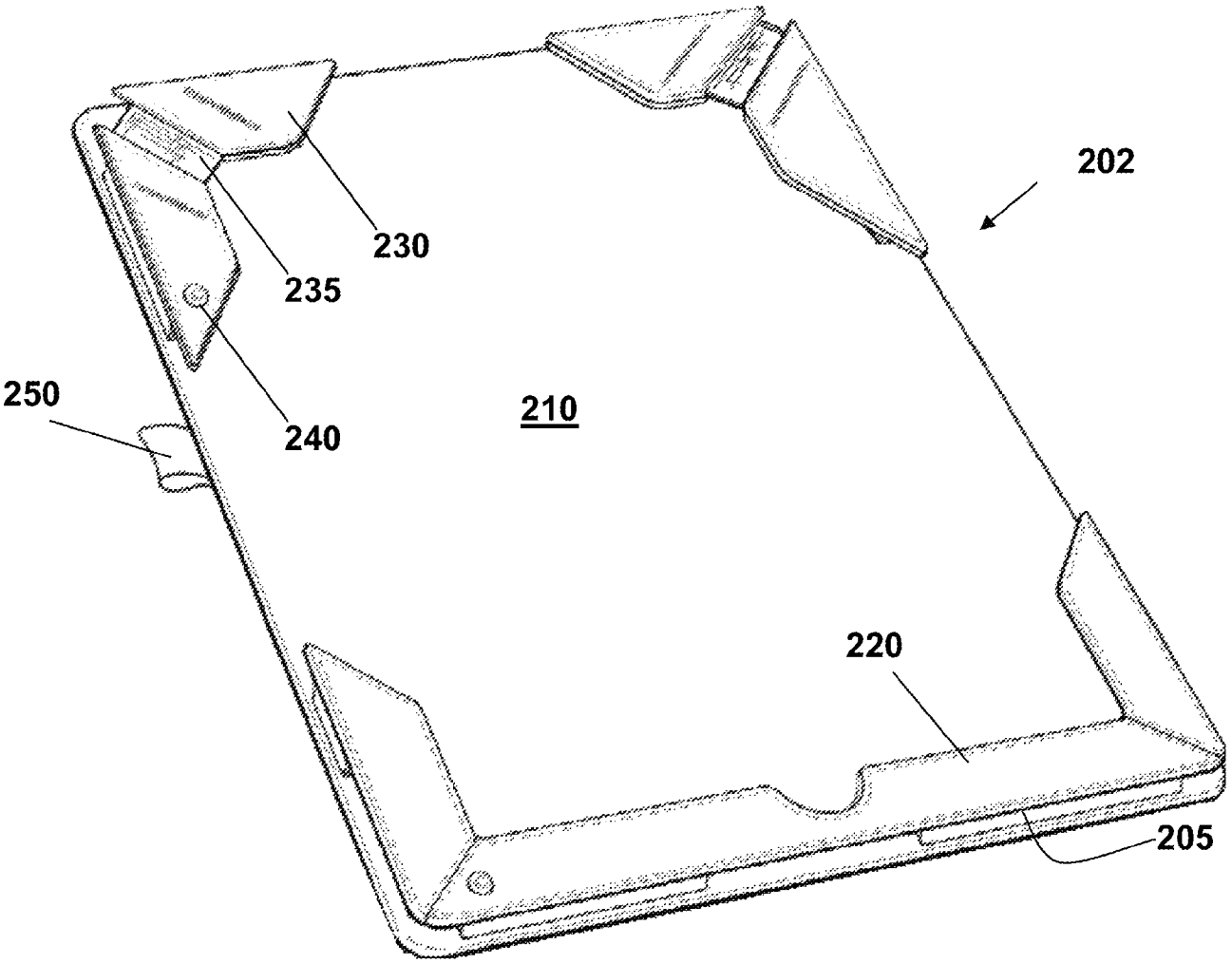
Figure 24:
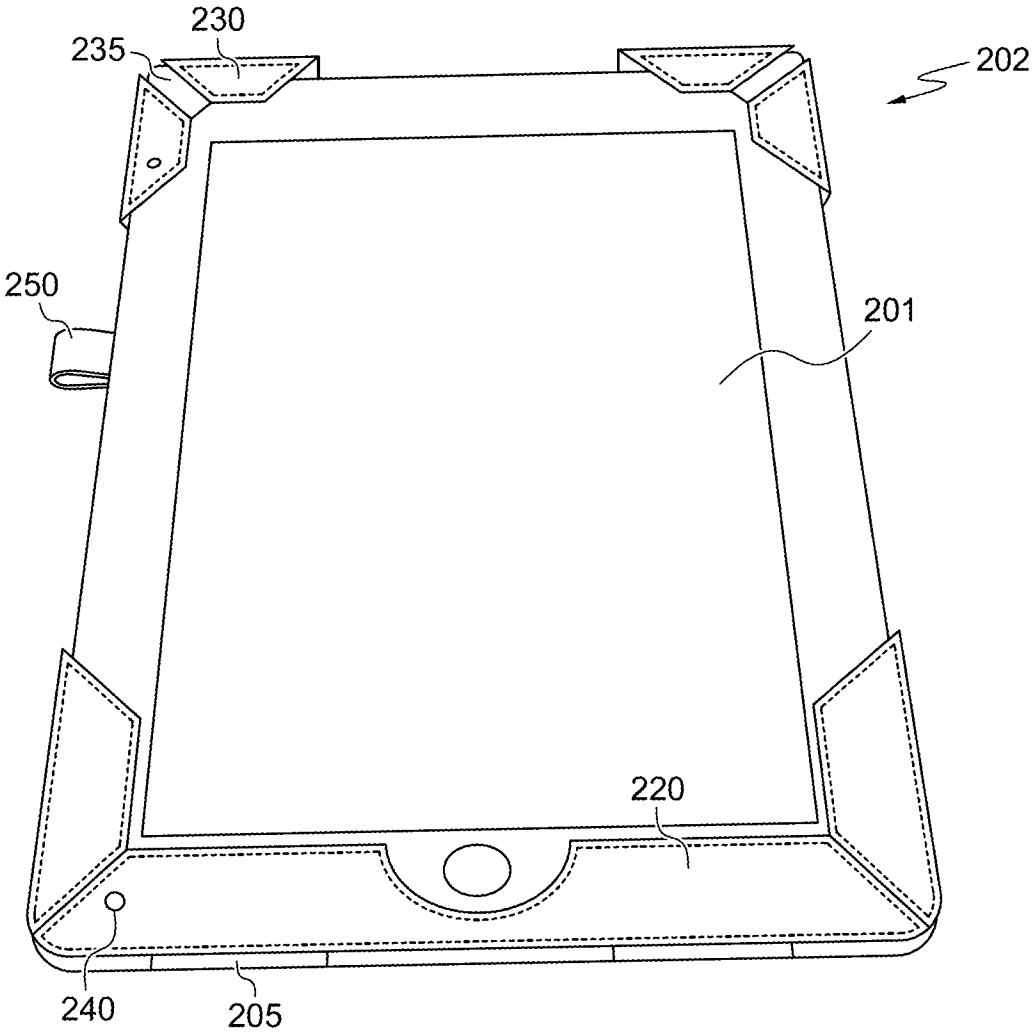
FIG. 24 is a perspective view of the frame of FIG. 6, with an electronic tablet positioned therein.

FIGS. 5 and 6 show perspective views of frame 200, 202, respectively, that may receive and hold contents such as an electronic tablet, or other display item 201, and bind the same into the case 100, 102. FIG. 24 shows a frame 200, 202 housing an electronic tablet as the display item 201. The frame 200, 202 may include a generally planar backing 210, with one or more side supports 220 or corner supports 230. The supports 220, 230 may be raised/spaced from the planar backing 210 by spacers 205 having a thickness about equal to the thickness of an electronic tablet or other display item 201 received therein. The corner supports 230 and/or side supports 220 may include elastic portions 235 to allow stretching of the supports 220, 230 while inserting, retaining or removing the contents, and to more securely hold the contents. The case 100, 102 and frame 200, 202 can include one or more frame attachment features, such as snaps 240, hook-and-loop fasteners, magnets, and the like, which releasably secure the frame 200, 202 to the case 100, 102. In one case the underside of frames 200, 202 (FIG. 22) may include additional attachment regions 341, 343, 345 which interact with corresponding attachment regions of the case 100, 102 to secure the frames 200, 202 in place, as will be described in greater detail below. The frame 202 (FIG. 6) may include a frame handle 250 in the form of a strap, loop, string, bungee cord, and the like. When the frame attachment features are unsecured, frame 200, 202 may be removable from case 100, 102.

Figure 7:
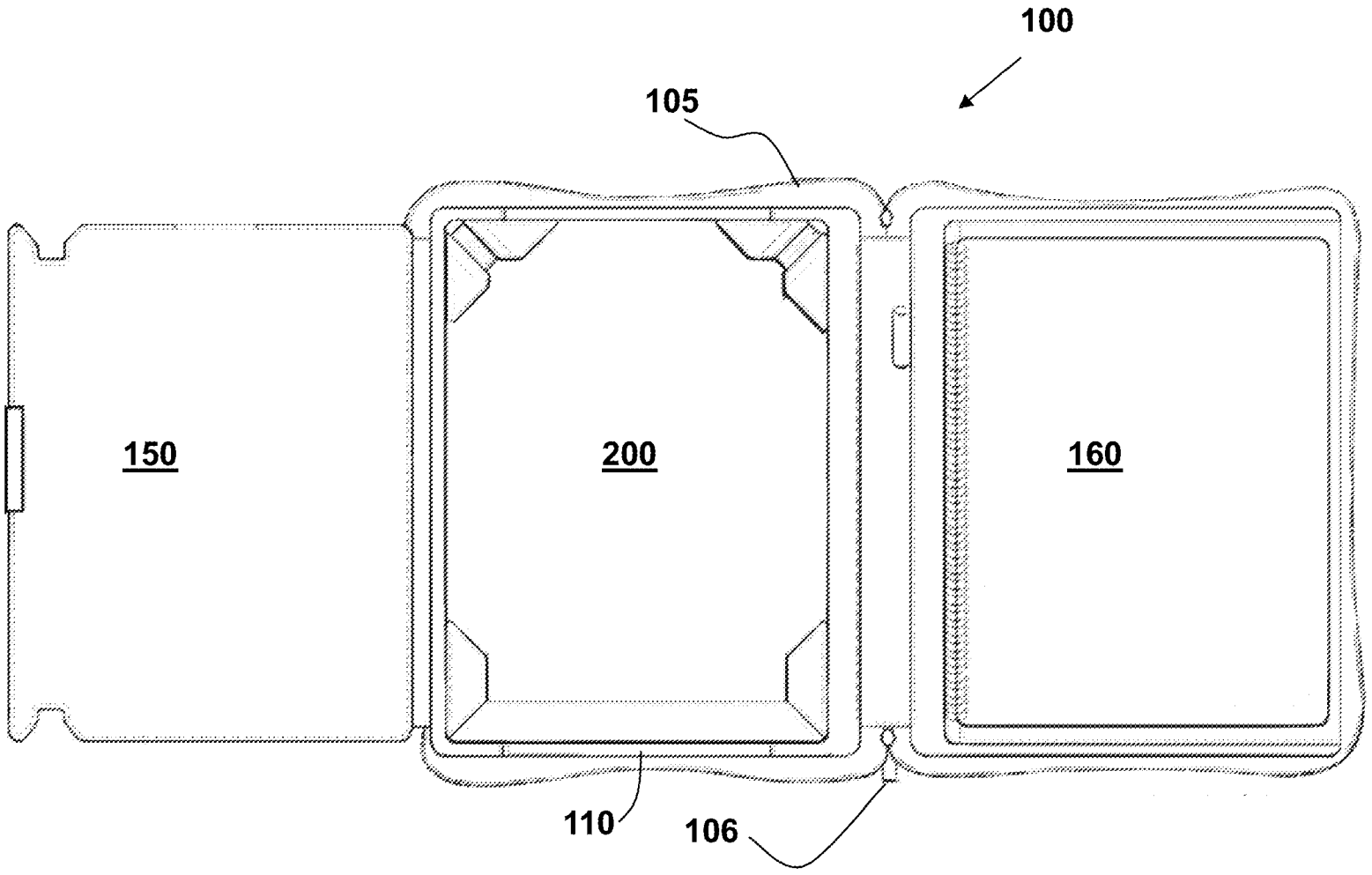
FIGS. 7 and 8 are plan views of the case of FIG. 1, utilizing the frames of FIG. 5 or 6 respectively.
Figure 8:
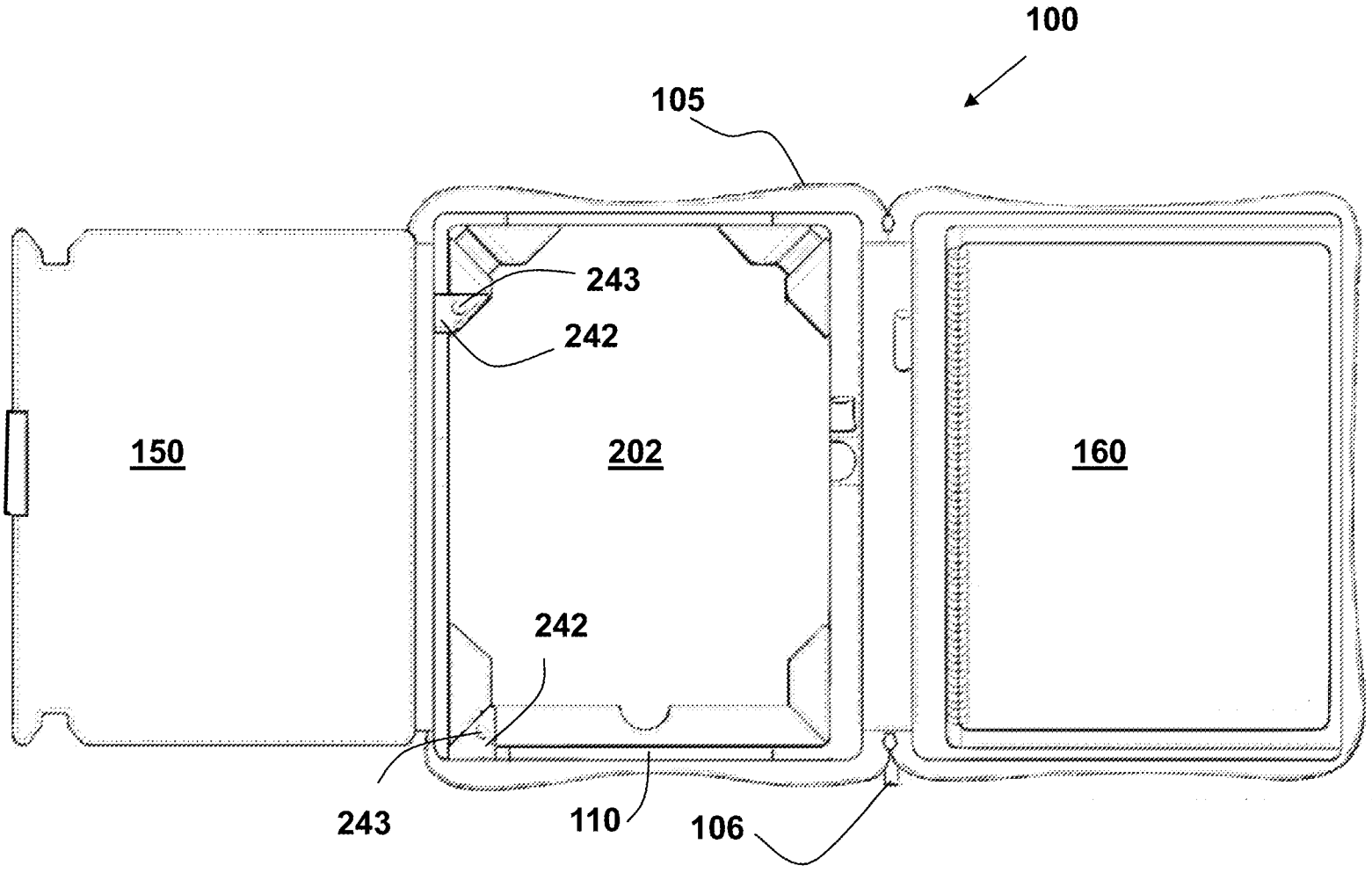
Figure 9:
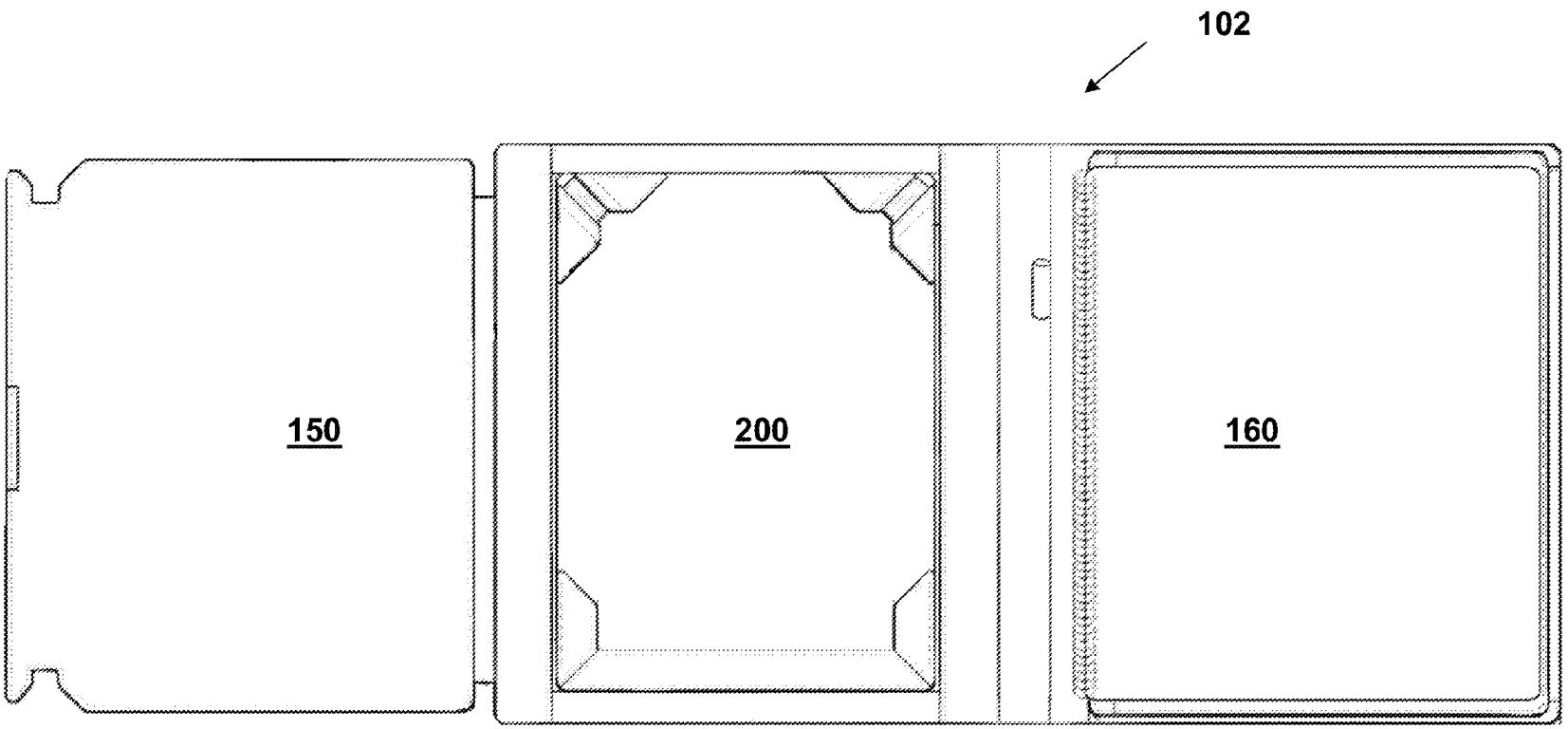
FIGS. 9 and 10 are plan views of the case of FIG. 2, utilizing the frames of FIGS. 5 and 6 respectively.
Figure 10:
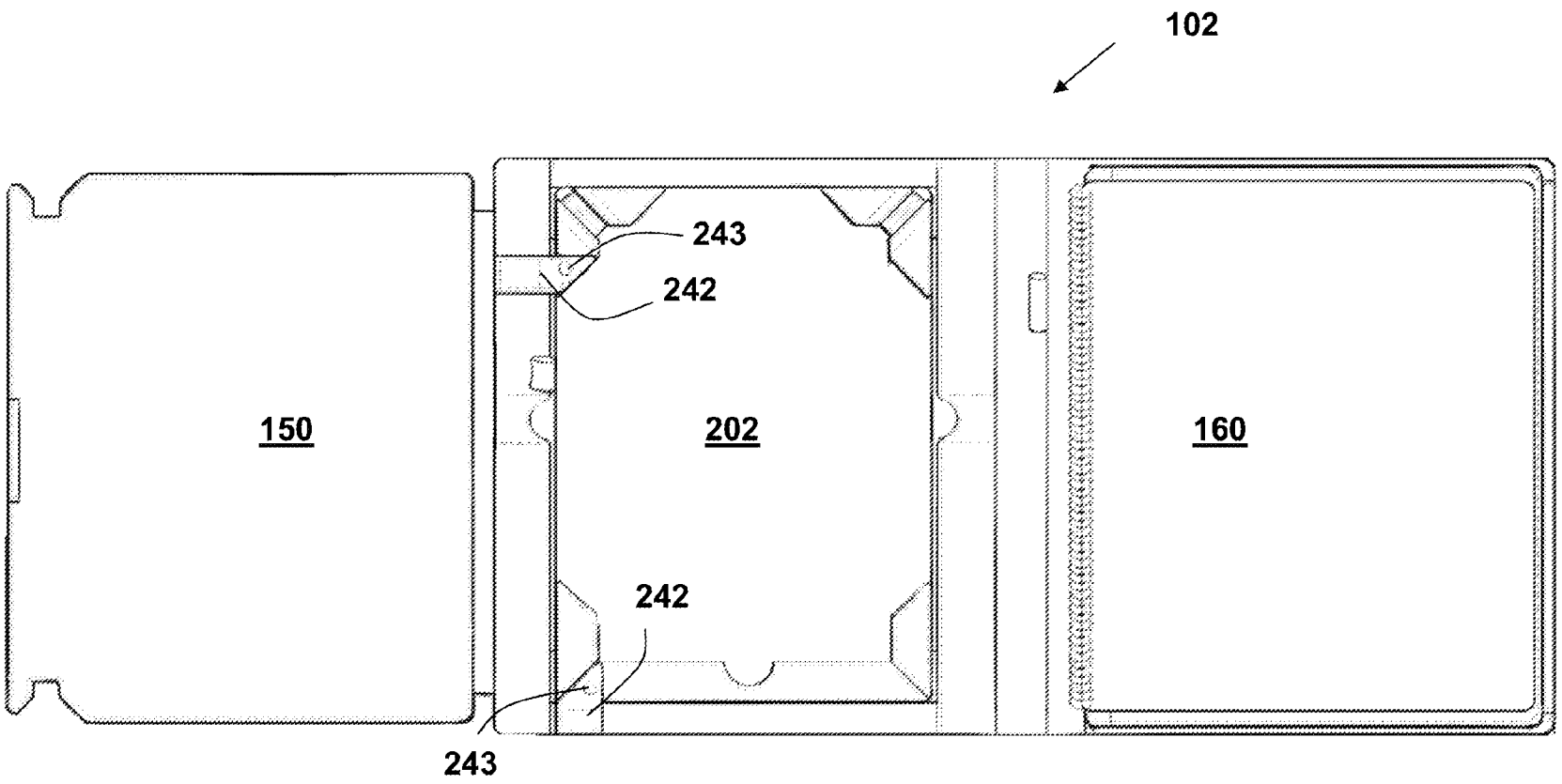

FIGS. 7 and 8 show frames 200, 202 respectively, installed in case 100 and positioned upon the inside surface of front cover 110. FIGS. 9 and 10 show frames 200, 202 respectively, installed in case 102 and positioned upon the inside surface of front cover 110. Case 100, 102 may include attachment straps 242 (see FIGS. 8 and 10) with snaps 243 that engage with snap 240 of frame 200, 202 to retain the frame 200, 202 in place. Alternately, or in addition, the front cover 110 may include attachment areas 319, 339, 359 in one case in the form of hook and loop fasteners (FIG. 12; described in more detail below) to connect with corresponding frame attachment features 341, 343, 345 (FIG. 22) on the underside of frame 200, 202 to secure frame 200, 202 to case 100, 102. In another embodiment, attachment features 341, 343, 345 are permanently or non-permanently installed directly upon display item 201 to attach display item 201 to the case 100, 102 without the use of frame 200, 202. As will be appreciated by one skilled in the art, other releasable fastening mechanisms such as magnets, ties, mechanical engagement devices, and the like may be provided to releasably secure frame 200, 202 or display item 201 to case 100, 102. It will also be appreciated by one skilled in the art that the full spectrum of releasable fastening mechanisms may apply to any of the fasteners and attachment devices addressed elsewhere in this disclosure, even if not specifically mentioned with respect to a particular fastening mechanism.

Figures 11A, 11B:
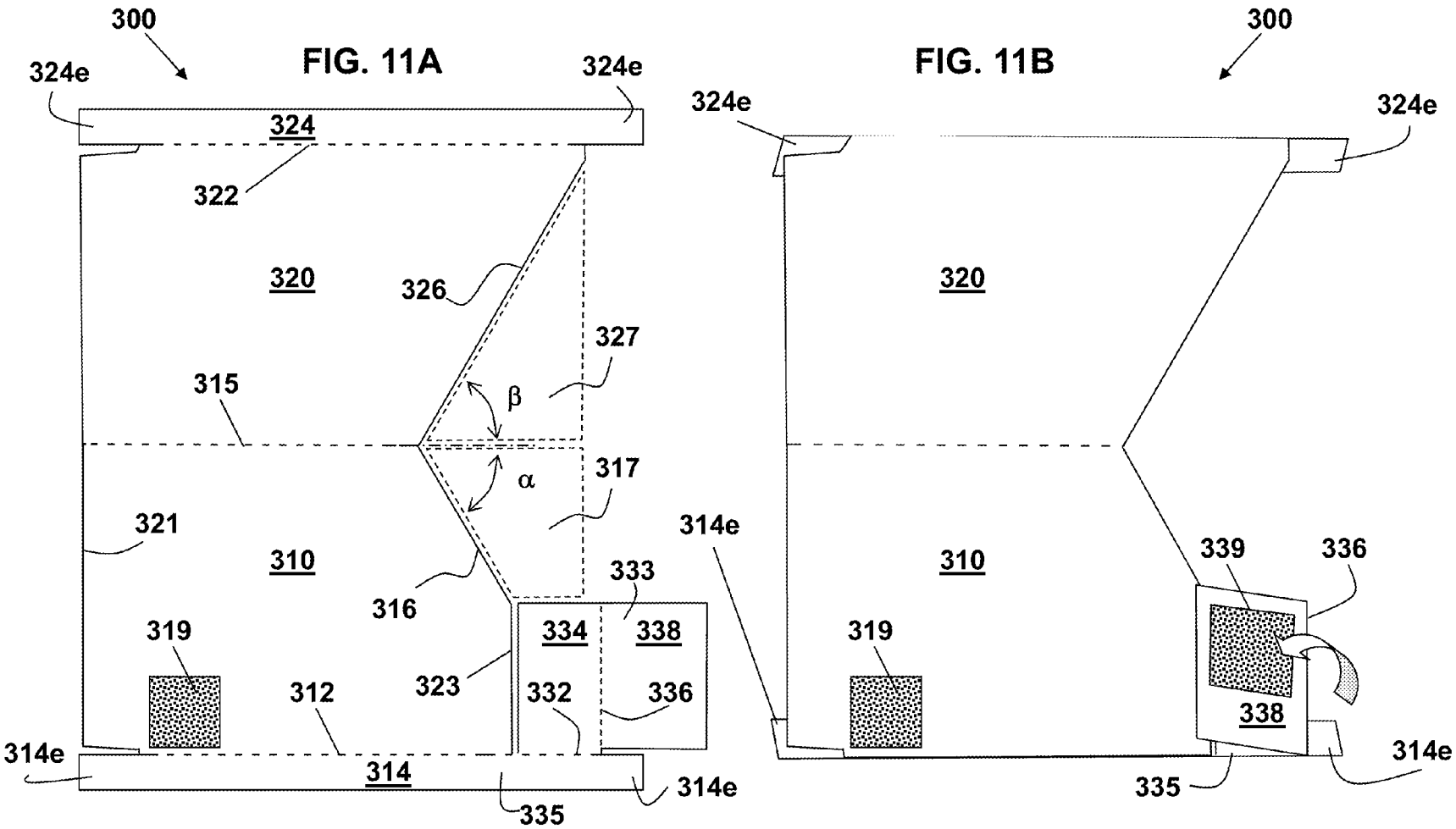
FIGS. 11A and 11B are plan views of an easel.

FIG. 11A shows a plan view of a support or collapsible easel 300 that may be positioned in the case 100, 102, such as on the front cover 110, to provide a variable support for a display item 201 such as an electronic tablet and/or frame 200, 202. The display item 201 may be attached directly to the support 300, or attached to a frame 200, 202, which is in turn attached to the support 300. The easel 300 may include two support panels or portions 310, 320, each with a respective base portion 314, 324 at its distal end. The support panels 310, 320 may be hingedly or foldably connected to each other through medial hinge line or joint, or easel fold line 315. Each base portion 314, 324 can also be hingedly or foldably connected to its associated support panel 310, 320 along of the base hinge lines 312, 322. Each base portion 314, 324 may have ends or tabs 314*e*, 324*e* protruding laterally outward.

Figure 22:
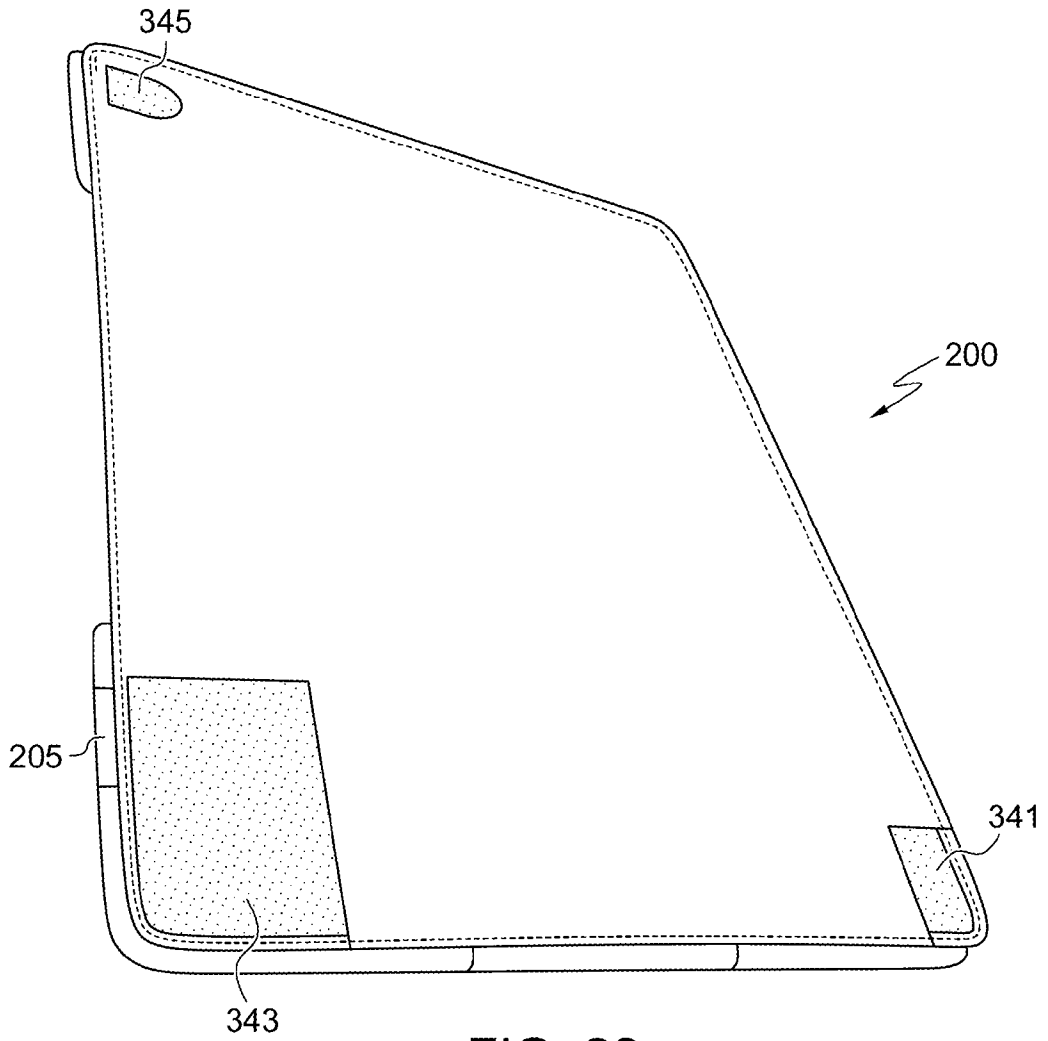
FIG. 22 is a perspective view of the underside of the frame of FIG. 5.

The easel 300, and more particularly the support panel 310, may be configured to be releasably coupled to the frame 200, 202 or display item 201. In particular the support panel 310 may have one or more attachment areas 319 configured to releasably attach the frame 200, 202 or another display item 201 such as an electronic tablet thereto. The attachment areas 319 may be hook-and-loop fasteners, magnetic areas, snap fasteners, adhesive, mechanical engagements, and the like, with corresponding attachment areas being located on the frame 200, 202 or display item 201 (for example snaps 240 in FIG. 6 or attachment feature 341 as illustrated in FIG. 22).

Figure 16B:
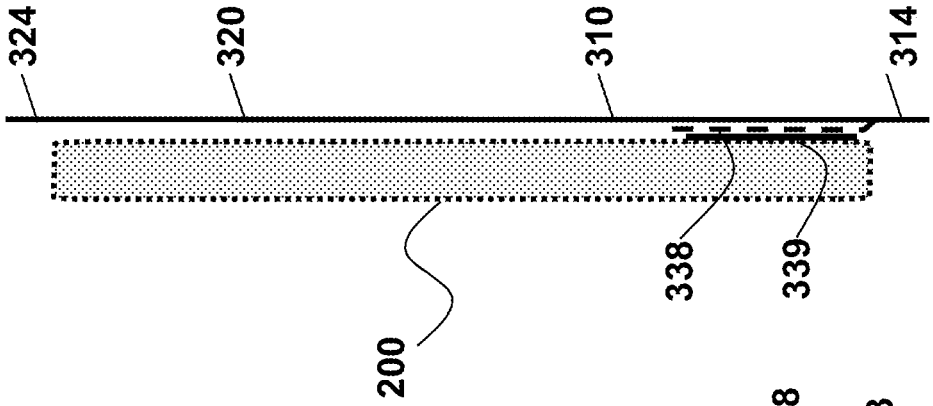
FIGS. 16A and 16B are plan and cross section views, respectively, of the easel in a flat configuration.
Figure 16A:
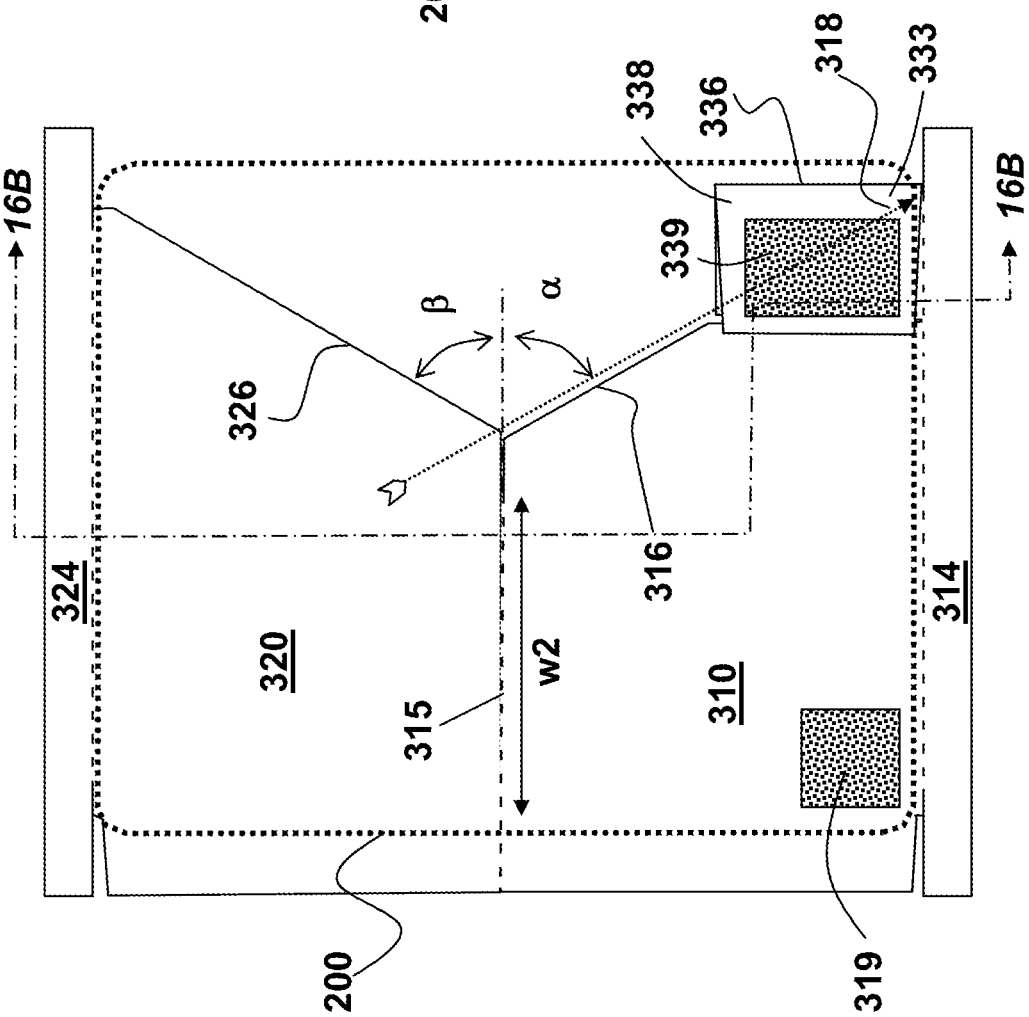

Each of the support panels 310, 320 may have, at a corner or region adjacent to the joint 315, a cutaway area 317, 327 whose function will be defined later with regard to FIGS. 16 and 17. The cutaway areas 317, 327 may be defined by angled edges 316, 326, which are positioned along the inner edges of support panels 310, 320 in the illustrated embodiment. The angled edges 316, 326 may be defined by angles $\alpha$, $\beta$ respectively, which, in one case, may be equal. The illustrated cutaway areas 317, 327 may have other shapes, for example as shown in FIGS. 18A-18F. Thus the edges of the cutaway area(s) 317, 327 may be angled, straight, or may have other shapes. The cutaway areas 317, 327 may be defined by material completely removed (or lacking) from the easel 300, or may at least partly defined by material of the easel 300 that is folded downward, backward, or underneath support panels 310, 320, in some cases as the easel 300 is raised.

Support panels 310, 320 may take any of a variety of shapes. In one embodiment, support panels 310, 320, may be substantially shaped as an irregular pentagon, as seen for support panel 310 in FIG. 11A. This substantially irregular pentagonal shape is defined by medial hinge line 315, first outer edge 321, base hinge line 312, second outer edge 323, and angled edge 316. Base hinge line 312 may directly intersect with first outer edge 321, but need not, as depicted. First outer edge 321 may be substantially parallel to spine 120 and substantially perpendicular to base hinge line 312 and medial hinge line 315. Support panels 310, 320 may alternately be substantially quadrilateral or trapezoidal in shape, or have other shapes, where angled edge 316 intersects directly with both medial hinge line 315 and base hinge line 312, thereby eliminating the second outer edge 323. Alternately, first outer edge 321 may be angled inward towards second outer edge 323 as opposed to being parallel to spine 120 (thus defining an additional cutout area on the outer side of support panel 310). Support panels 310, 320 need not be the same shape, and the substantially irregular pentagonal and substantially trapezoidal embodiments described herein should not be read to limit the full spectrum of potential shapes for support panels 310, 320.

Figure 12:
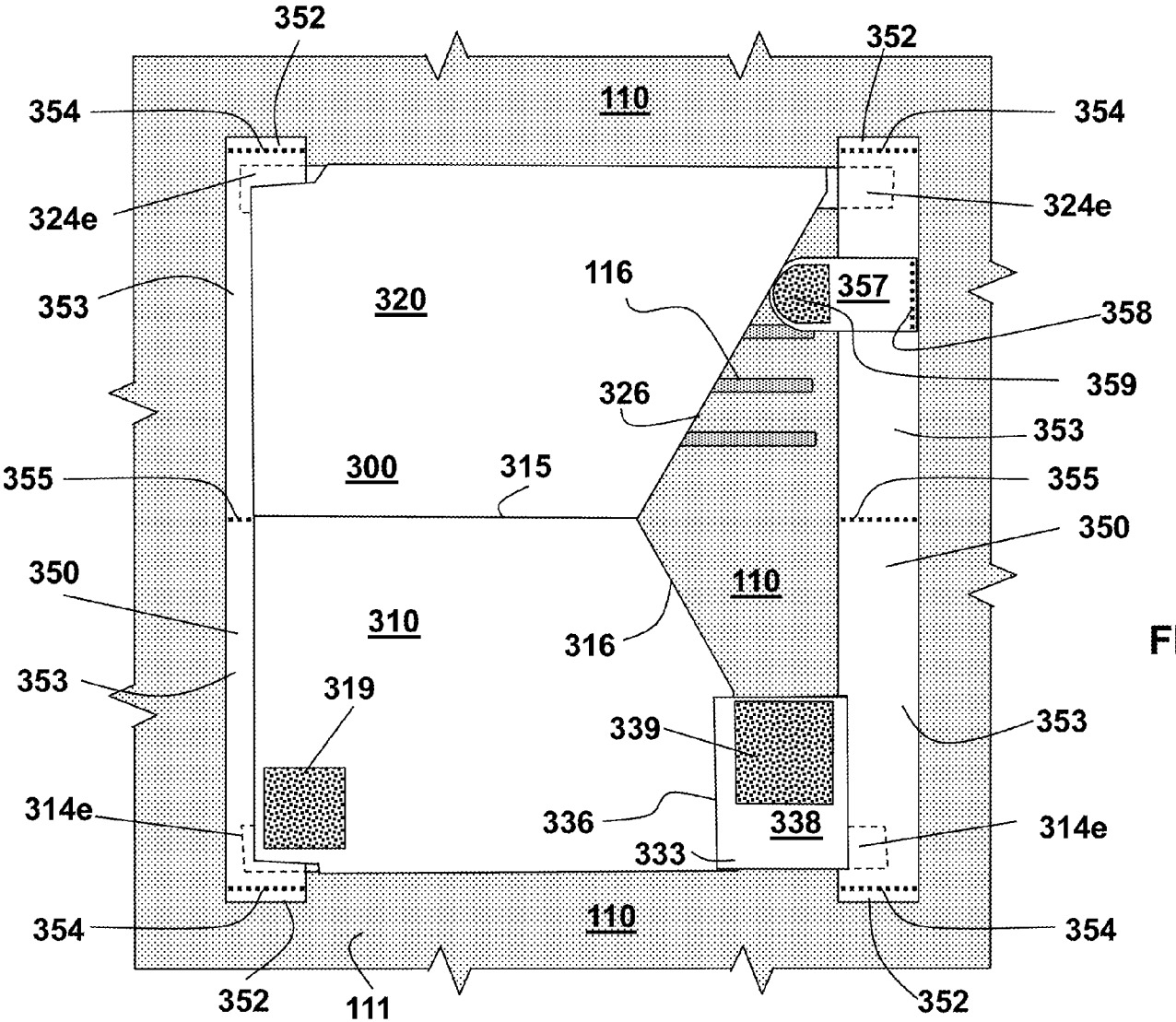
FIG. 12 is a plan view of the easel in a substantially planar configuration interfacing with a support panel.
Figure 13B:
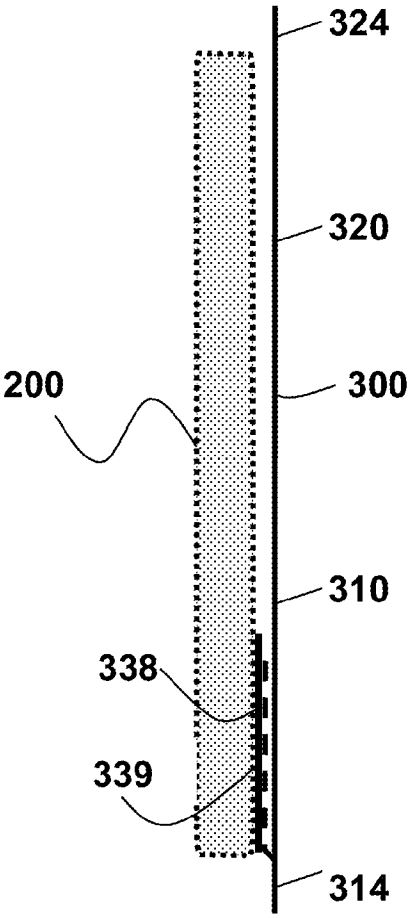
FIGS. 13A and 13B are plan and cross section views of the easel of FIG. 12 in a substantially planar configuration.
Figure 13A:
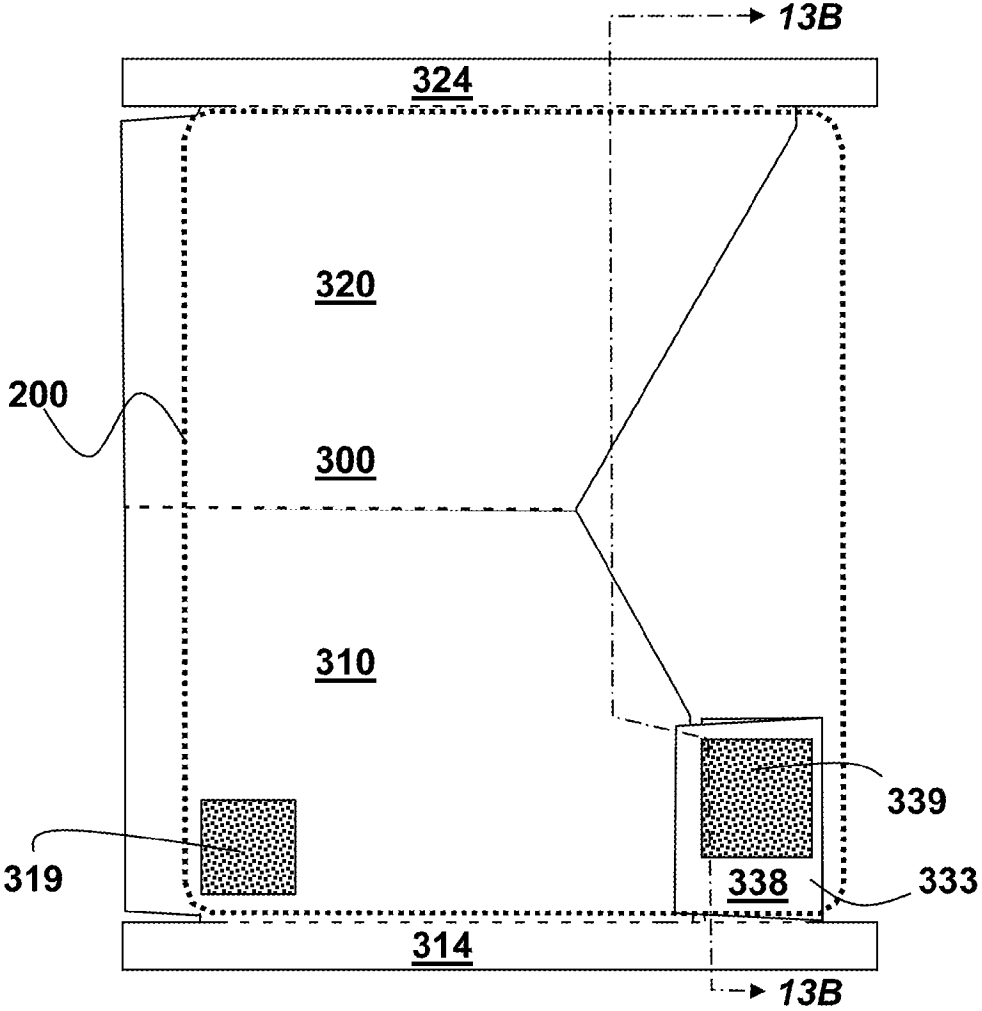

As shown in FIG. 12, easel 300 may be attached to a supporting surface 111. Supporting surface 111 may be front cover 110, back cover 130, front flap 150, back flap 132, or any other panel or surface within case 100, 102 of sufficient dimensions, as will be appreciated by one skilled in the art. Supporting surface 111 may be a panel that is integral with or removable from case 100, 102.

Figure 26:
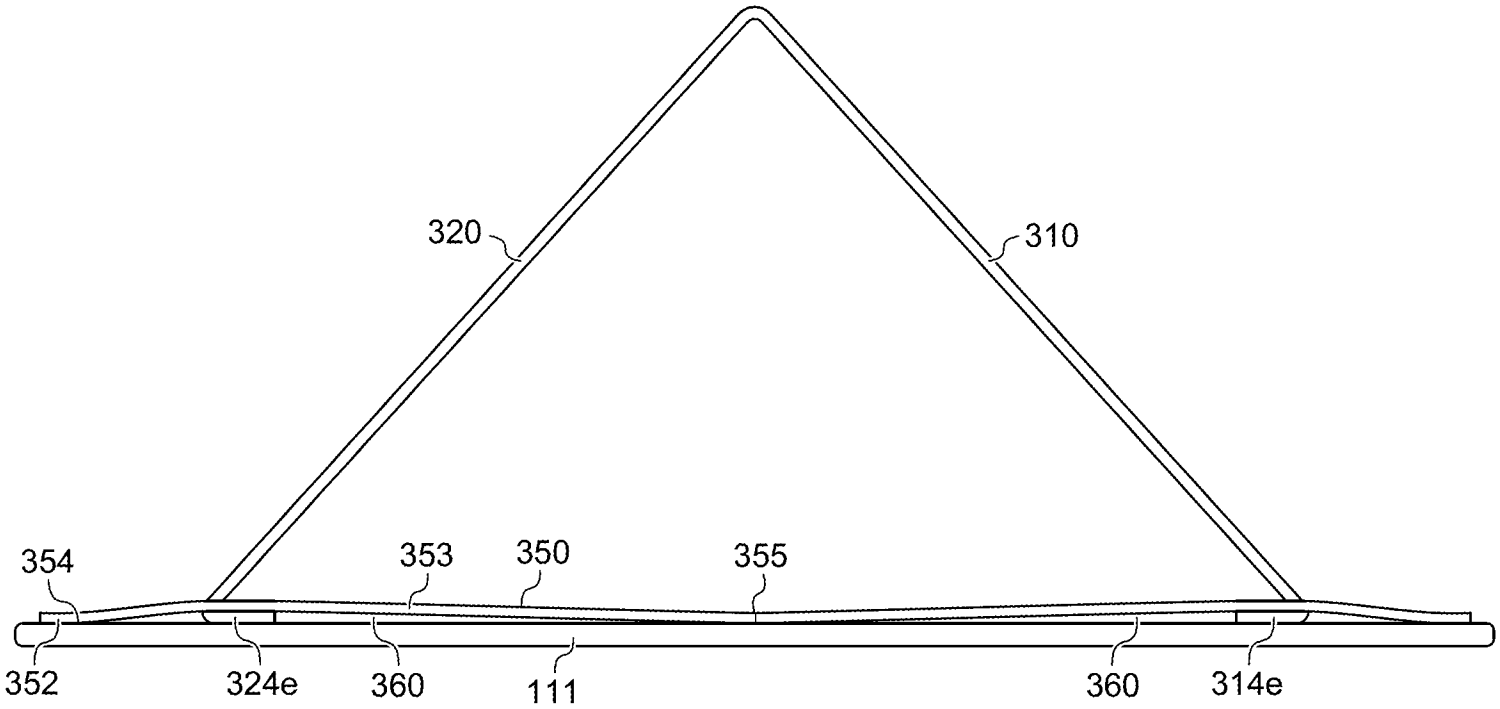
FIG. 26 is a side view of the easel in a propped configuration interfacing with a support structure.

Referring to FIGS. 12 and 26, the supporting surface 111 may include one or a plurality of parallel, spaced-apart rails 350 (strips of material, for example) thereon. In one case, there are two rails 350. The rails 350 may be attached to the underlying supporting surface 111 at one or both ends 352 by stitching 354 or by staples, glue or adhesives, etc. Rails 350 may be releasably attached to the supporting surface 111. Other portions 353 of the rails 350 may be unattached to the supporting surface 111, and the unattached portions 353 may comprise the majority of the length of rails 350, defining tracks or gaps 360 between the rails 350 and supporting surface 111.

Figure 23:
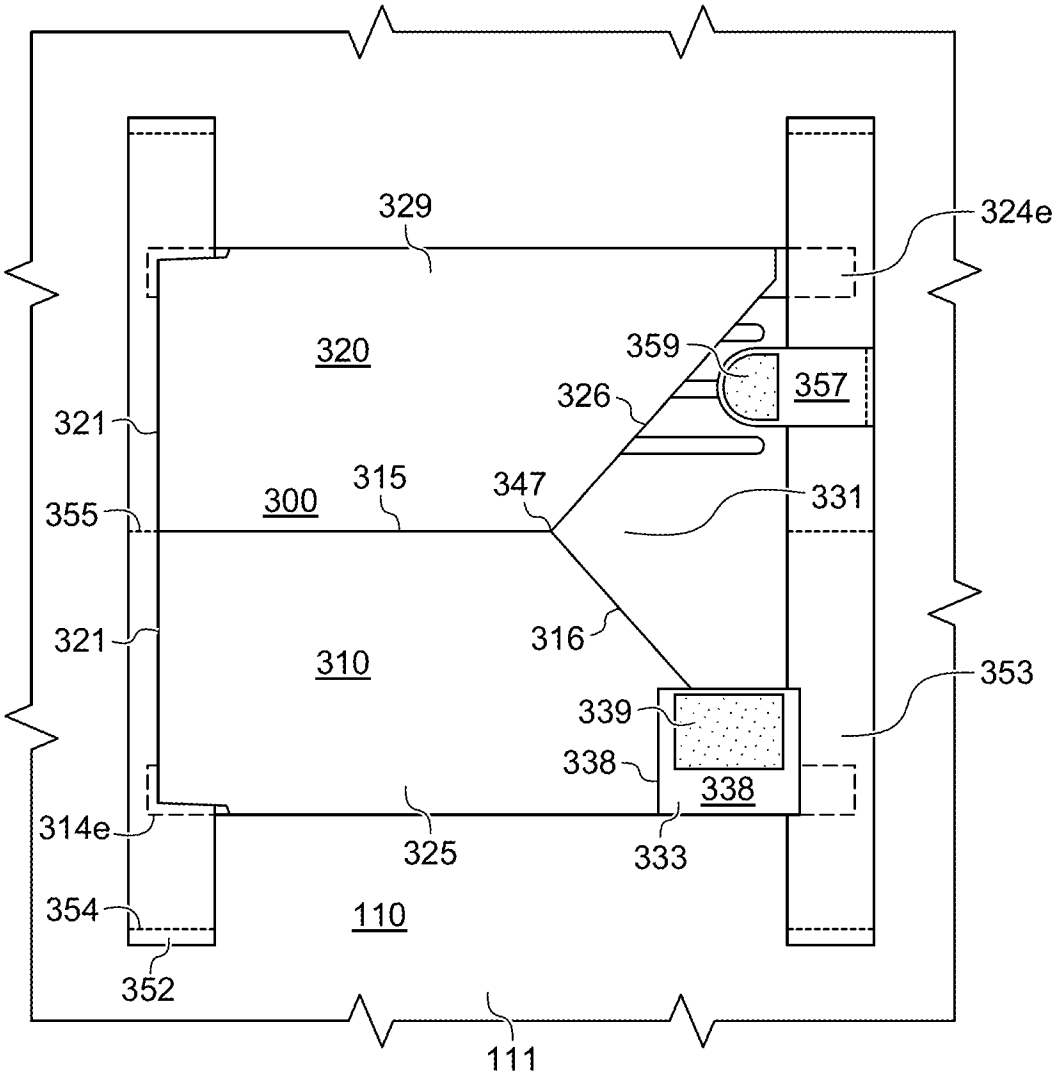
FIG. 23 is a plan view of the easel of FIG. 12 in a propped configuration.

As noted above, the base portions 314, 324 of easel 300 have ends or tabs 314*e*, 324*e* at one or both sides (e.g. left and right as illustrated in FIG. 12) that may be slidably positioned within tracks 360; that is, between unattached portions 353 of rails 350 and supporting surface 111. As will be explained in more detail below, the variable positioning of tabs 314*e*, 324*e* along the length of rails 350 (and within tracks 360) provides variable positioning of easel 300 between a flat, substantially planar configuration, where support panels 310 and 320 are substantially coplanar and tabs 314*e*, 324*e* at maximum distance from each other (as illustrated in FIG. 12), and a variety of propped configurations where at least one of tabs 314*e*, 324*e* is slidably repositioned along an unattached portion 353 of rail 350 toward the opposite tab 314*e*, 324*e*, which, in turn, causes panels 310, 320 to rise upwardly away from supporting surface 111, as depicted in FIGS. 23 and 26. In the illustrated embodiments of FIGS. 23 and 26, medial hinge line 315 defines the highest point of the easel 300 relative to supporting surface 111. Because the base portion tabs 314*e*, 324*e* may slide under rails 350, the footprint of the easel 300 on supporting surface 111 may thus be shortened or lengthened as shown in FIGS. 13-17 depending upon the positioning of tabs 314*e*, 324*e* relative to rails 350.

One or all rails 350 may be attached to supporting surface 111 at an intermediate point or points 355 such as the midpoint of each rail 350, for example by stitching. The intermediate attachment point 355 on rail 350 may limit the movement of the base portion tabs 314*e*, 324*e* to prevent improper positioning of the easel 300 by restricting the effective size of tracks 360. The intermediate attachment points 355 may also stabilize the rails 350 and prevent excessive flexing of the rails 350.

One or more attachment members 357 may be coupled to the upper surface of a rail 350 to couple a display item such as frame 200, 202 or display item 201 to the supporting surface 111. The attachment members 357 may be fastened to a rail 350 or to the supporting surface 111, for example by stitching 358. Preferably, the stitching 358 does not interfere with the sliding movement of the base portion tabs 314*e*, 324*e* within tracks 360, and the attachment member 357 should not restrict the movement of either support panel 310, 320. The attachment member 357 may include an attachment region 359 such as a hook and loop fastener material or other suitable device to releasably attach to a complementary region on frame 200, 202 or other display item 201.

Base portion ends 314*e*, 324*e* may slide relatively easily under rails 350 within the tracks 360 so that the easel 300 may be readily adjusted, but with enough friction or other resistance so that once adjusted to the desired position, the easel 300 is held steady and fixed in position. The friction between the base portion ends 314*e*, 324*e* and the rails 350 and supporting surface 111 may be adjusted by choice of materials, size of the base portion ends 314*e*, 324*e*, clearance between the rails 350 and supporting surface 111, or by any other method known to one skilled in the art to manipulate the strength of frictional engagement. The supporting surface 111 can also include frictional force adjustment features 116 which can take the form of bumps, ridges, grooves, and other surface features suitable for helping to hold the base portions 314, 324 in the desired position on the supporting surface 111. Also, as seen in FIGS. 11B and 12, base portions 314, 324 of easel 300 may be folded about base hinge lines 312, 322 under the associated support panels 310, 320 without hindering the sliding function.

It may be possible to use the easel 300 on a supporting surface 111 that lacks rails 350. For example, in one case, the base portions 314, 324 (or the adjacent edges of the support panels 310, 320) can be made of a tacky, adherent, or otherwise suitable material that provides enough friction against the supporting surface 111 to hold the easel 300 in place (as well as frame 200, 202 or other display item 201 resting thereupon).

One of the base portions 314, 324 of easel 300 may be attached to supporting surface 111 by a permanent attachment (such as stitching, stapling, welding, permanent glue, etc.) or by a temporary attachment (such as hook-and-loop fastener, magnet, snaps, grooves, bump, or ridges in the underlying support, etc.), while the other of the base portions 314, 324 may be attached to an underlying supporting surface 111 by a temporary attachment, or remain unattached. The temporary attachment(s) permit adjustment of the angle of easel 300 and its forward-backward positioning.

Referring now to the functionality of easel 300, when the easel 300 is in the propped configuration, easel 300 can have a variety of slanted support planes 325 capable of supporting an item such as frame 200, 202 or display item 201. For instance, referring to FIG. 23, each support panel 310, 320 can define a support plane 325, 327, respectively, which are in a non-parallel configuration. Further, the angled edges 316, 326 of the support panels 310, 320 define a third slanted support plane 331 that is not parallel with the support planes 325, 327. A fourth angled support plane (not depicted) analogous to support plane 331 may be included by forming the edges 321 of support panels 310, 320 as angled edges analogous to edges 316, 326, but on the opposite side of support panels 310, 320.

Figures 14A, 14B, 14C, 14D:
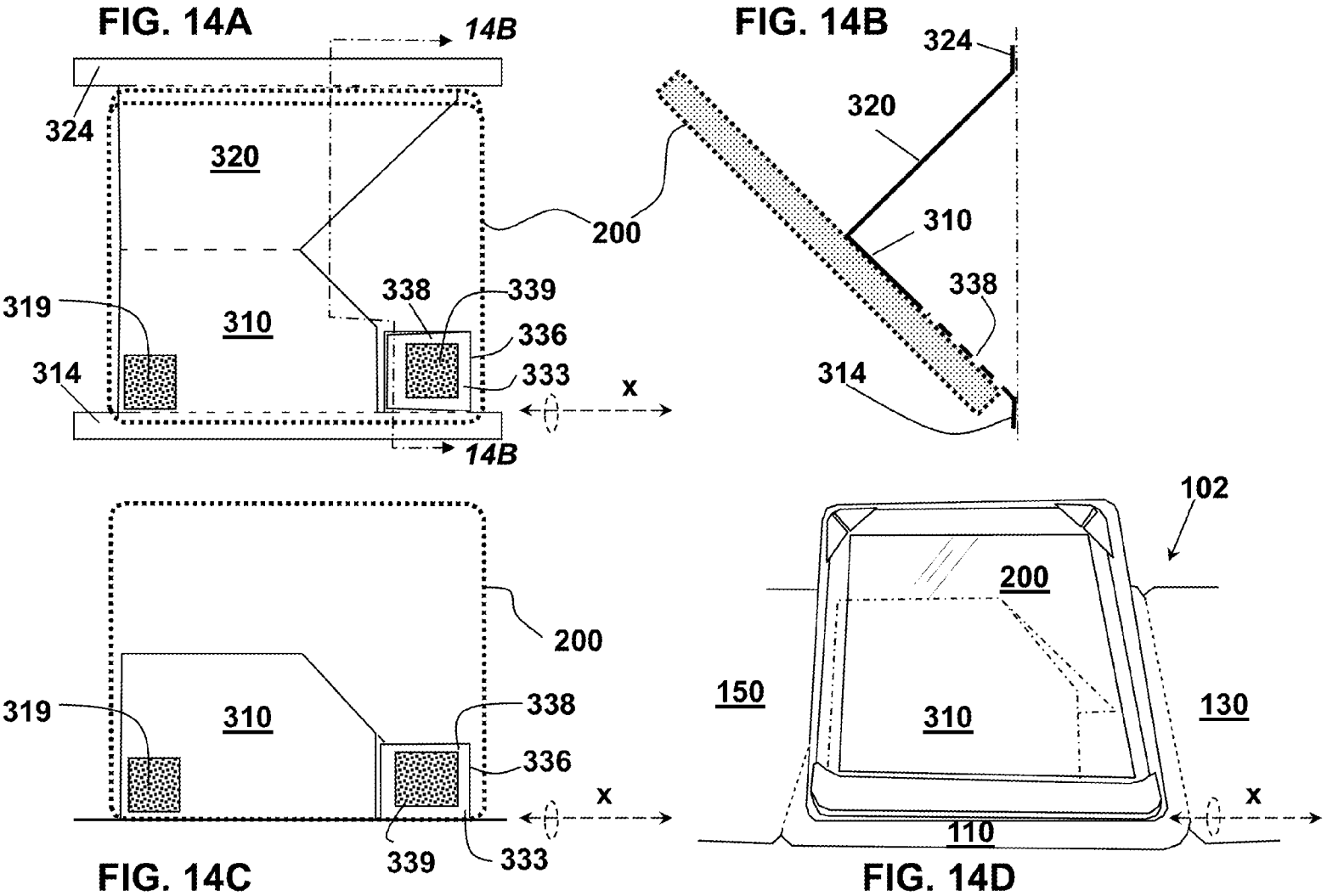
FIG. 14A is a plan view of the easel in a propped configuration at a first angle.
FIG. 14B is a side cross section view of the easel of FIG. 14A, with the frame supported thereon in a forward-facing configuration.
FIG. 14C is a front view of the easel of FIG. 14A.
FIG. 14D is a front perspective view of the frame and easel of FIG. 14B.
Figures 17A, 17B, 17C, 17D:
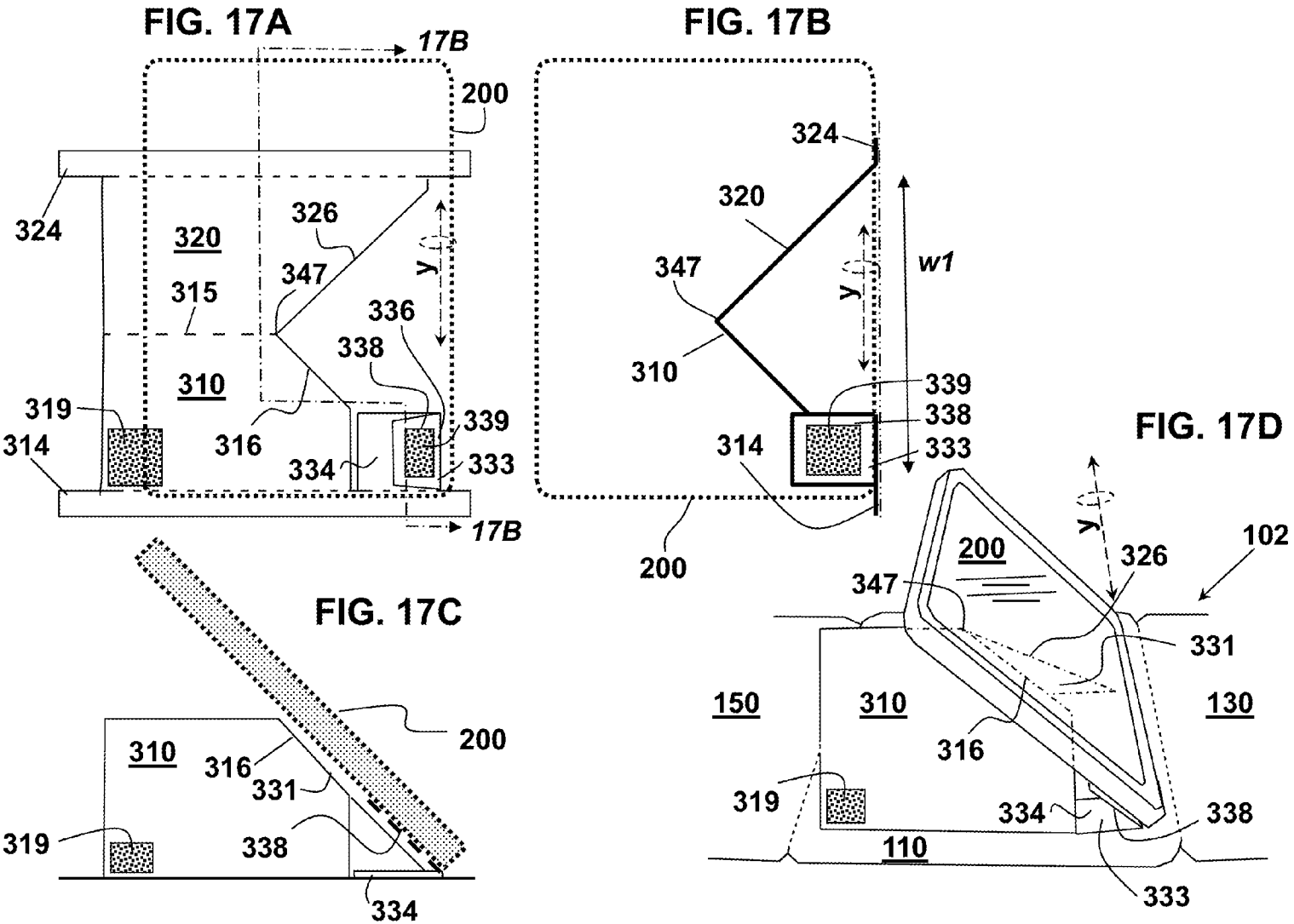
FIG. 17A is a plan view of the easel in propped configuration.
FIG. 17B is a side cross section view of the easel of FIG. 17A.
FIG. 17C is a front view of the easel of FIG. 17A, with the frame supported thereon in a forward facing configuration.
FIG. 17D is a front perspective view of the frame and easel of FIG. 17C.

By virtue of the variety of the support planes 325, 327, 331, when the easel 300 is in the propped position, the easel 300 can support the frame 200, 202 or display item 201 in multiple orientations and configurations. For instance, support planes 325, 329 may support frame 200, 202 and/or display item 201 such that the top and bottom edges of the frame 200, 202 and/or display item 201 are generally parallel with medial hinge line 315 and substantially perpendicular to spine 120, as depicted in FIG. 14D. Alternately, support plane 331 may support frame 200, 202 and/or display item 201 thereon such that the top and bottom edges of the frame 200, 202 and/or display item 201 are generally perpendicular to the medial hinge line 315 and substantially parallel with the spine 120, as seen in FIG. 17D. Further, frame 200, 202 or display item 201 may be able to be positioned in a portrait or landscape orientation against any of the support planes 325, 327, 331.

Referring now to FIG. 11A, the case 100, 102/easel 300 may include a bi-axial hinge 333 configured to be coupled to the frame 200, 202 and/or display item 201. The bi-axial hinge can guide the frame 200, 202/display item 201 as the frame 200, 202/display item 201 moves between the position shown in FIG. 14D and the position shown in FIG. 17D. In particular, the bi-axial hinge 333 can include a first hinge portion 334 pivotally coupled to a second hinge portion 338 along a secondary fold line 336. The second hinge portion 338 is pivotally coupled to an anchor portion 335 of the base portion 314 of easel 300 along a primary fold line 332. The fold lines 332, 336 can extend substantially perpendicularly to each other. The bi-axial hinge 333 may thus be considered to have three sections: 1) the anchor portion 335, connected through a first fold line 332 to 2) the first hinge portion 334, which is in turn connected through secondary fold line 336 to 3) the second hinge portion 338, where the first fold line 332 and secondary fold line 336 are perpendicular or substantially perpendicular to one another.

FIG. 11B shows a first step in arranging the bi-axial hinge 333 for use by folding second hinge portion 338 upward and over first hinge portion 334 about secondary fold line 336. The upper face of second hinge portion 338 may have an attachment area 339 such as hook and loop fastener, magnetic material, snap fasteners, adhesive, mechanical engagement, and the like. Attachment area 339 may attach to a complementary attachment region 343 or another feature on frame 200, 202 (FIG. 22), or on the display item 201 directly.

Figure 25:
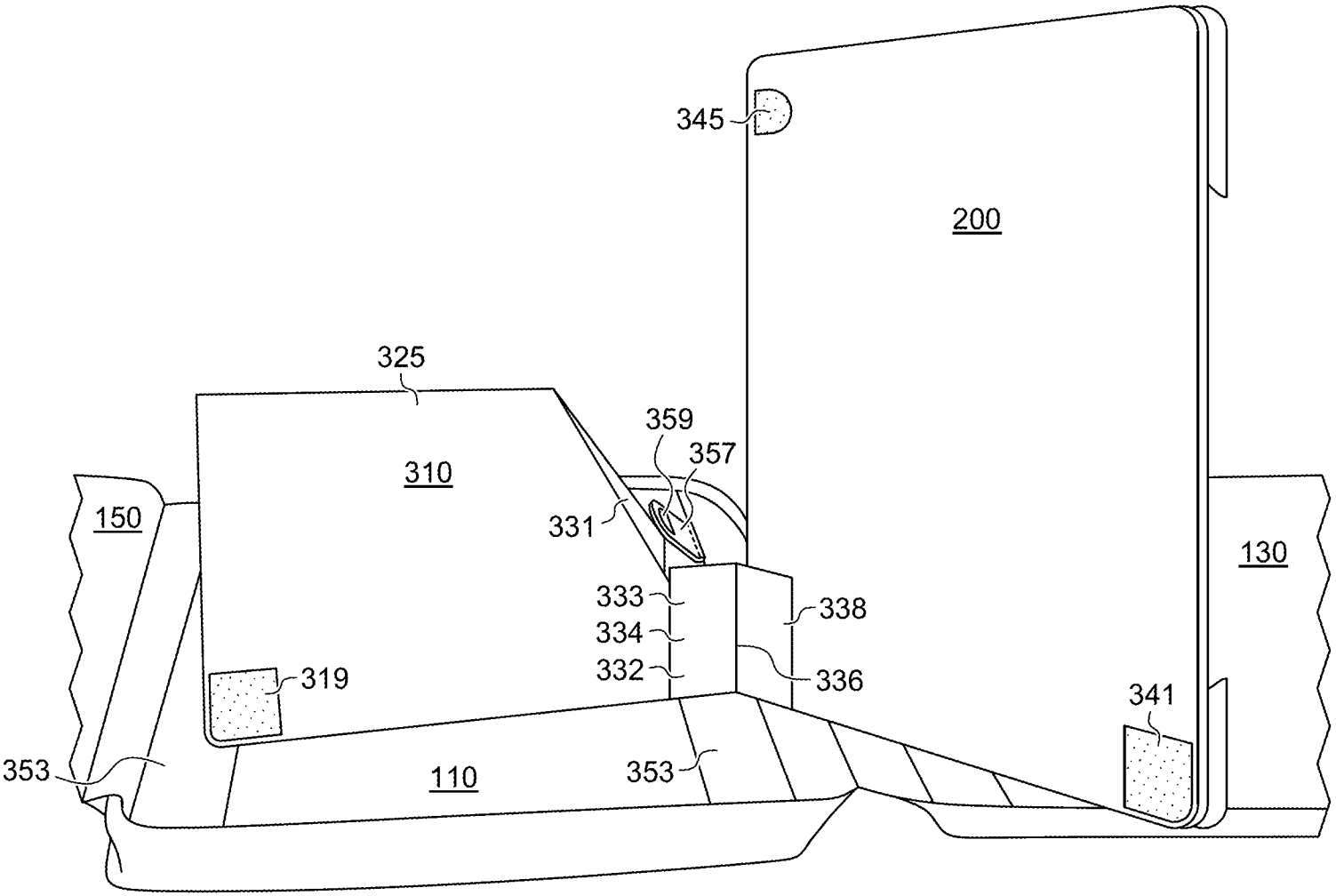
FIG. 25 is a perspective view of the easel, frame, and hinge where the easel is in a propped configuration and the frame is attached to the hinge in a pivot position.

As seen in FIG. 25, the flexibility and range of motion of bi-axial hinge 333 facilitates its use as a pivot assist for frame 200, 202 or display item 201 on easel 300. FIG. 25 shows frame 200 attached to second hinge portion 338 via attachment area 339 of second hinge portion 338 and attachment area 343 of frame 200. Fold lines 332, 336 of bi-axial hinge 333 allow frame 200 to be positioned alternately, as desired by a user, against support plane 325 or support plane 331 without detaching frame 200 from bi-axial hinge 333. To position frame 200 against support panel 310/support plane 325, the user pivots bi-axial hinge 333 (and frame 200, 202 or display item 201) along first fold line 332 until first hinge portion 334 is substantially coplanar with support panel 310, and then pivots bi-axial hinge 333 (and frame 200, 202 or display item 201) along secondary fold line 336 until frame 200 is positioned against support panel 310 (in this configuration, first hinge portion 334 and second hinge portion 338 are flattened against each other, as suggested in FIG. 11B and shown in FIG. 12).

To position frame 200, 201/display item 201 against support plane 331, the user pivots bi-axial hinge 333 along first fold line 332 until first hinge portion 332 is substantially parallel with supporting surface 111 (i.e. flat against front cover 110), and then pivots bi-axial hinge 333 along secondary fold line 336 until frame 200 is positioned generally parallel with and against support plane 331. As will be appreciated by one skilled in the art, the described pivot steps may be performed in any order, or simultaneously.

One skilled in the art will appreciate that other or additional bi-axial hinge arrangements (not shown) may be included in to provide similar pivotal relationships between other adjacent support planes of easel 300, and that additional attachment areas may be added to the components as necessary to secure frame 200, 202 or display item 201 to easel 300.

Additional attachment regions 319, 359, located on easel 300 and supporting surface 111 respectively (see FIGS. 12, 25), may be included to provide additional stabilizing support for frame 200 or other display item when positioned against support planes 325, 331. Attachment region 319 corresponds with attachment feature 341 of frame 200, and attachment region 359 corresponds with attachment feature 345 (see FIG. 22). When the easel 300 is in the propped position and frame 200, 202/display item 201 is positioned against propped support panel 310, attachment region 319 of easel 300 and attachment feature 341 of frame 200, 202/display item 201 may be coupled to secure frame 200, 202/display item 201 in position on support panel 310 of easel 300, which, in conjunction with the previously described attachment of frame 200, 202/display item 201 to bi-axial hinge 333, results in both of the corners of frame 200, 202/display item 201 proximal to supporting surface 111 being stably secured. When the easel 300 is in the propped position and frame 200 is positioned against support plane 331, attachment region 359 (on attachment member 357 of supporting surface 111 or rail 350) and attachment feature 341 of frame 200 may be coupled to secure frame 200 in position on support plane 331 of easel 300, which, in conjunction with the previously described attachment of frame 200 to bi-axial hinge 333, results in both of the corners of frame 200 proximal to supporting surface 111 being stably secured. Securing at least two corners of frame 200 to easel 300/supporting surface 111 provides the additional benefit of decreasing the risk that frame 200, 202 or the display item 201 will unintentionally detach from case 100, 102.

The attachment region 339 on second hinge portion 338 may be somewhat larger than the attachment regions 319, 359 so that the attachment region 339 is capable of holding rather strongly relative to attachment regions 319, 359, while attachment regions 319, 359 may be smaller or hold less strongly but still hold a frame 200 or other content on the easel 300. This makes it easier for the user to move frame 200 from one support plane 325, 331 to another (which requires detachment from attachment region 319, 359) without detaching attachment region 339, which could undesirably detach frame 200 from bi-axial hinge 333.

When easel 300 is in the substantially planar configuration, all three attachment regions 319, 339, and 359 may simultaneously couple with attachment features 341, 343, 345 of frame 200, 202 or display item 201, which can provide maximum security. This secure attachment may also serve to stabilize the frame 200, 202 or display item 201 when the case 110, 102 is flattened or closed for transport, because maximizing the total number of attachments minimizes the risk that the frame 200, 202 or display item 201 will become detached when the case 100, 102 is carried or stored.

With the basic principles and benefits of the easel 300, hinge 333, and frame 200, 202 now described, the following discussion expands upon the functionality and illustrates the interactions of the various components in a variety of use scenarios.

When the easel 300 is raised to a propped orientation (as shown in FIGS. 14-15) from a substantially planar position (i.e. after transport), and the frame 200, 202/display item 201 is in a forward-facing orientation on the support plane 325, attachment regions 339/343 and 319/341 may hold or stabilize the frame 200, 202 or display item 201, but attachment regions 359/345 may be unattached to allow the upper portion of the frame 200 to lift away from supporting surface 111. Alternately, when the frame 200, 202/display item 201 is positioned on support plane 331 (as shown in FIG. 17), attachment regions 339/343 and 359/345 may hold or stabilize the frame 200, 202 or display item 201, but attachment regions 319/341 may be unattached to allow the left portion of the frame 200, 202 or display item 201 to lift away from supporting surface 111.

Instead of resting upon support panel 310, the frame 200, 202 or display item 201 could instead rest upon support panel 320, which forms support plane 329. For example, this could be done by detaching the frame 200, 202 or display item 201 from the hinge portion 338 and easel 300 and moving the frame 200, 202 or display item 201 around to rest upon support panel 320. In these configurations, complementary attachment feature 345 on the back of frame 200 does not contact attachment area 359 of attachment member 357 because the portrait orientation of frame 200 raises attachment feature 345 out of range for such attachment.

In addition, rather than resting upon the right side of the propped easel 300, e.g. on angled edges 316, 326, the frame 200, 202 or display item 201 could be supported upon the outer left side of the propped easel 300. This could be done by detaching the frame 200, 202 or display item 201 from hinge portion 338 of bi-axial hinge 333, and moving the frame 200, 202 or display item 201 around to the outer/left side of the easel 300. The outer/left edges 321 of support panels 310, 320 might be shaped differently (e.g. angled inward) to give a range of support angles on the outer/left side of the easel 300 to provide additional display options for the user.

Figures 15A, 15B, 15C:
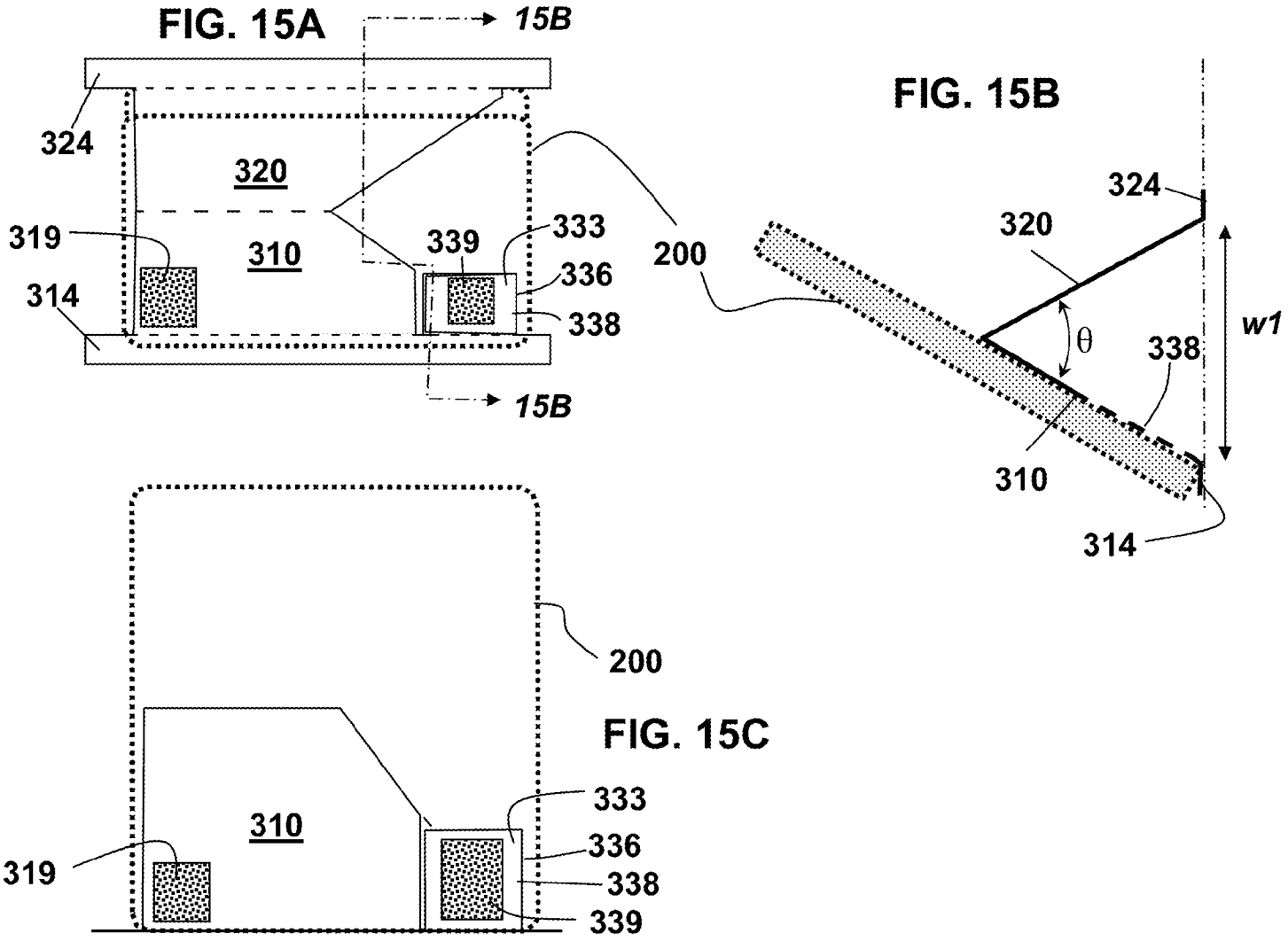
FIG. 15A is a plan view of the easel in a propped configuration at a second, higher angle.
FIG. 15B is a side cross section view of the easel of FIG. 15A, with the frame supported thereon in a forward-facing configuration.
FIG. 15C is a front view of the easel of FIG. 15A.

FIGS. 15A-15C show similar views to FIGS. 14A-14C, except that the easel 300 has been further raised to a more upright standing position by sliding base portions 314, 324 closer together. By adjusting the distance w1 (see FIG. 15B) between the base portions 314, 324, the angle θ of the easel 300 may be smoothly adjusted between a lie-flat, substantially planar configuration (θ approaches 180° and w1 is at a maximum) and a near-vertical propped configuration (θ approaches 0° and w1 is at a minimum). For some more active use patterns, such as typing on a virtual keyboard on an electronic tablet 201, the lie-flat configuration may be advantageous. For other more passive use patterns, such as viewing videos or making a presentation, a more upright configuration may be desirable.

FIGS. 17A-17D illustrate the characteristics of easel 300 and frame 200, 202 or display item 201 with respect to a sideways-facing display configuration using support plane 331. In one embodiment, the angled edges define support plane 331, and the frame 200 or display item is supported by edges 316, 326 and is generally co-planar with support plane 331. The cutaway areas 317, 327 (see FIG. 11A) provide room for frame 200 in the landscape orientation. In the configuration shown in FIG. 17D, frame 200 rests on at least one of the angled edge 316 of support panel 310 and the angled edge 326 of the support panel 320. If the cutaway areas 317, 327 are not defined by straight lines as in FIG. 11A, the display item may rest upon one or more points 347 along edges 316, 326 (see 316*a-f*, 326*a-f* of FIG. 18). Point 347 may be located at the intersection of angled edges 316, 326 with medial hinge line 315, and if edges 316, 317 are not in precise alignment with frame 200, point 347 may define a support structure for frame 200 or other display item.

When in the sideways-facing orientation, frame 200, 202 or display item 201 can remain attached to bi-axial hinge 333 via second hinge portion 338, which pivots upward about the secondary hinge line 336. Thus frame 200, 202 or display item 201 and the second hinge portion 338 pivot about a second axis (denoted "y") that is perpendicular to the first axis "x" of the configuration shown in FIGS. 14A-14D. For the sideways-facing orientation shown in FIG. 17D, it may be advantageous for the easel 300 to be moved toward the user, e.g. forward (rather than away from the user) so that frame 200 will remain positioned over front cover 110, rather than extending beyond the upper edge of front cover 110, a configuration that might be less stable or take up more desk or lap area. As shown in FIGS. 17A-17D, frame 200 is in a landscape orientation on easel 300.

Changing the pivot axis from x to y enables changing the display of the orientation of the frame 200, 202 or display item 201 from a "tall" or "portrait" orientation to a "wide" or "landscape" orientation (or vice versa). An electronic tablet may contain a sensor or sensors to detect its orientation and automatically reconfigure its display accordingly.

The angled edges 316, 326, when provided by straight lines as in FIG. 11A, may be easier to construct, and may advantageously provide a more continuous support for the frame 200, 202 or display item 201 in the sideways configuration of FIG. 17, since most of the length of angled edges 316, 326 may contact the back of the frame 200, 202 or display item 201. However, as shown in FIGS. 18A-18F, the cutaway areas 317, 327 (and consequently their edges) may have other shapes, and may be defined by lines that are not straight.

Figure 18C:
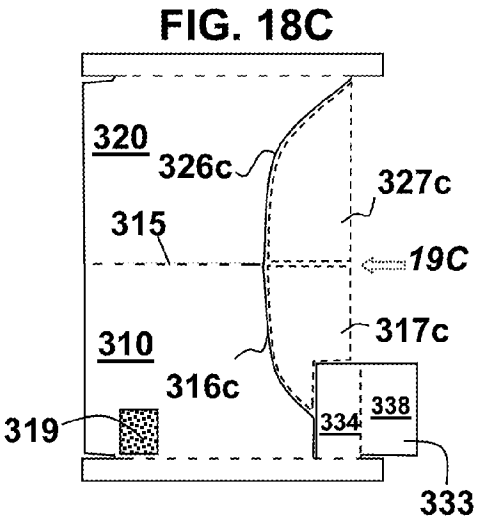
FIGS. 18A-18F are plan views of alternative easel designs.
Figure 18B:
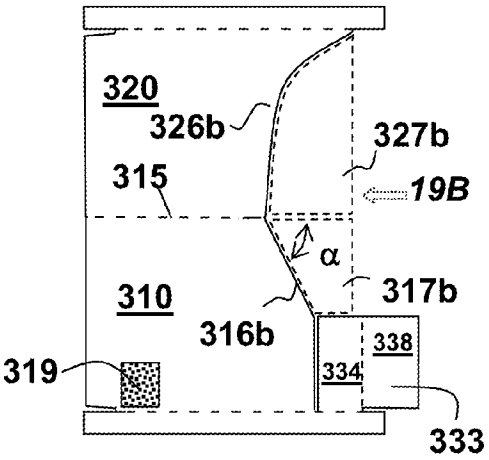
Figure 18A:
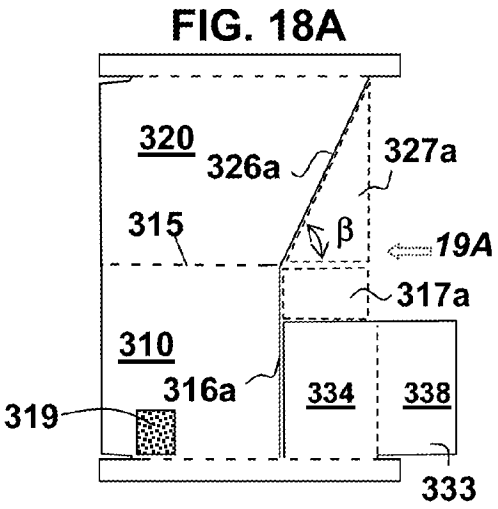

FIG. 18A shows an easel 300 where most or all of the support for a frame 200, 202 or display item 201 in the sideways orientation may be provided by linear contact with angled edge 326*a*, while edge 316*a* is a vertical line, moved to the left. Such a configuration may allow the use of larger first hinge portion 334 and/or second hinge portion 338. This configuration may still be considered to have a cutaway area 317*a* adjacent support panel 310.

FIG. 18B shows an easel 300 where most or all of the support for a display item 201 such as frame 200, 202 in the sideways orientation may be provided by linear contact with angled edge 316*b*, while edge 326*b* has a curved or concave profile which may offer less contact.

FIG. 18C shows an easel 300 where both edges 316*c*, 326*c* have a curved or concave profile. With such a configuration, the amount of support for a display item 201 such as frame 200, 202 may depend on the geometry of the edges 316*c*, 326*c*. This might offer less support than the linear contact areas provided as shown in FIGS. 11A, 18A, and 18B. However, display items such as electronic tablets can be fairly lightweight so that the support area provided by a curved edge or edges 316*c*, 326*c* may still be adequate.

Figure 18F:
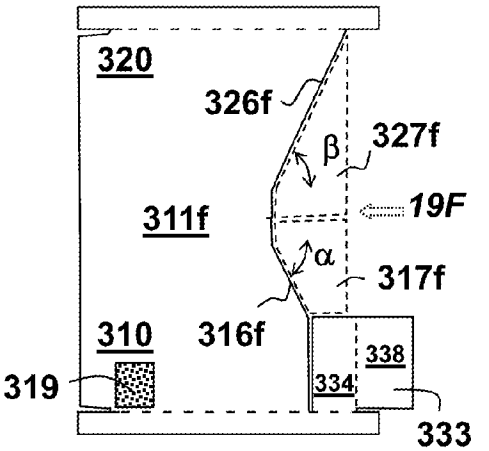
Figure 18E:
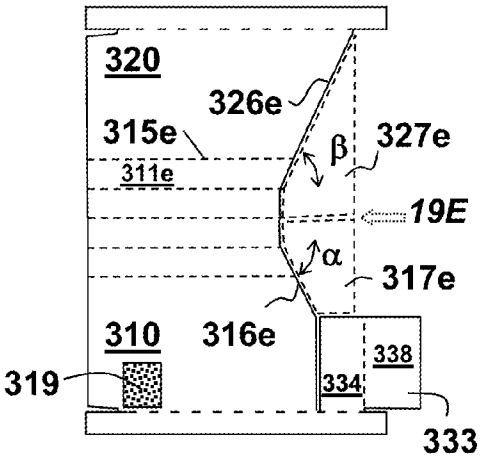
Figure 18D:
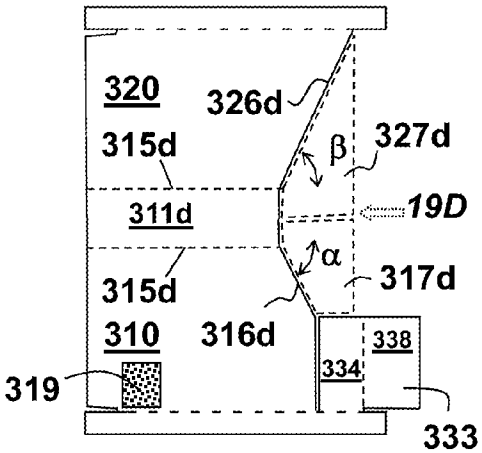

FIG. 18D shows an easel 300 where instead of a single medial hinge line 315, the easel 300 includes multiple medial hinges lines 315*d* and a medial planar area 311*d*. With such a configuration, the frame 200, 202 or display item 201 in the sideways orientation may be supported by edges 316*d*, 326*d*, and also the inner/right edge of the medial planar area 311*d*. The easel 300 may include more than two medial hinge lines and more than one medial planar area 311*d*.

FIG. 18E shows an easel 300 with several medial hinges lines 315*e* and a several medial planar areas 311*e*. With such a configuration, when frame 200, 202 or display item 201 is in the sideways orientation, it may be supported by edges 316*e*, 326*e*, and also the inner/right edges of the medial planar areas 311*e*.

Figure 19A:
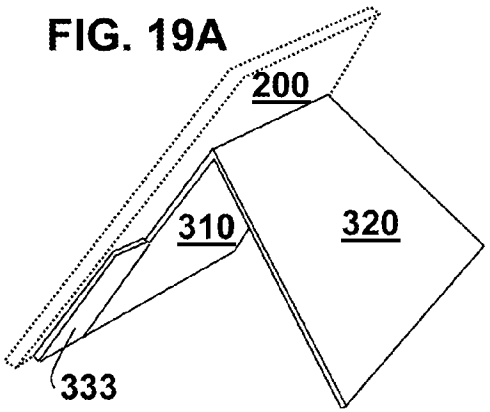
FIGS. 19A-19F are perspective views of the easels of FIGS. 18A-18F, each in a raised configuration.
Figure 19B:
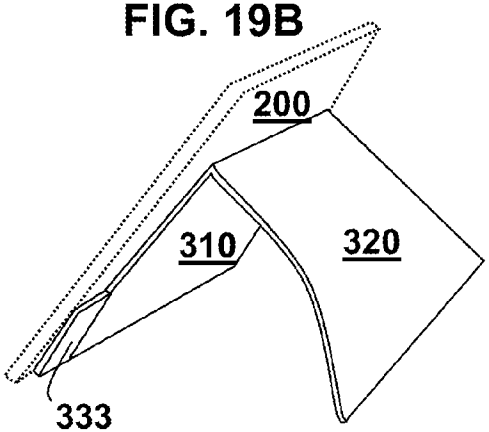
Figure 19C:
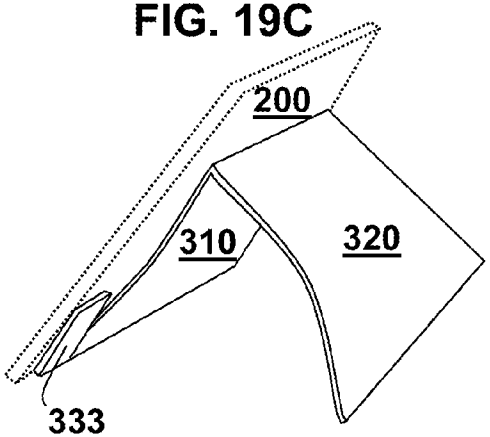
Figure 19D:
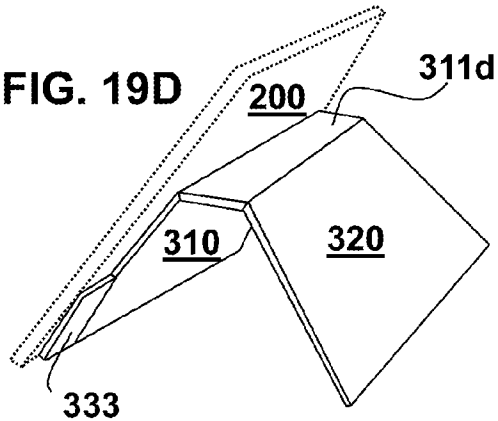
Figure 19E:
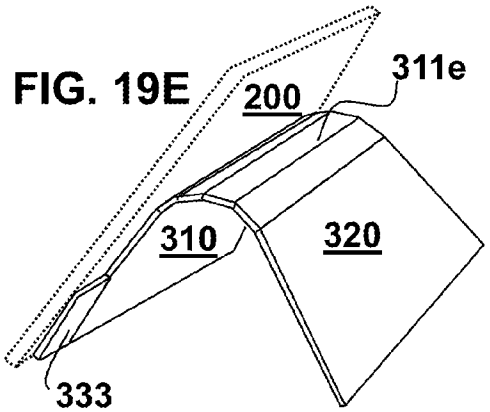
Figure 19F:
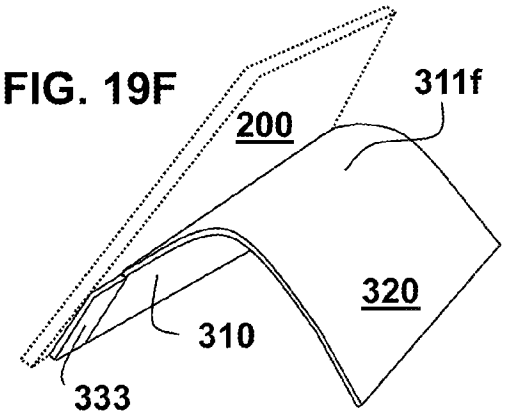

FIG. 18F shows an easel 300 where at least the region 31 if between support panels 310, 320 may be a flexible material that allows a propped configuration to be formed without necessarily requiring any medial hinge lines in the easel 300, as shown in FIG. 19F. Alternately the support panels 310, 320 and the region 311*f* between them may be a single flexible region which allows a "tent" shape to be formed. Such a "tent" shape may have an arched form rather than a peaked form. With such a configuration, the frame 200, 202 or other display item 201 in the sideways orientation may be supported by edges 316*f*, 326*f*, and also the right edge of the region 311*f*.

FIGS. 19A-19F show perspective views in the raised configuration of the easels 300 of FIGS. 18A-18F. The views are from the right side of the easel 300, as denoted in FIG. 18A etc. Frame 200 is shown in the "forward facing" orientation. The easels 300 can also be used in the "sideways facing" orientation as described previously.

Figure 20:
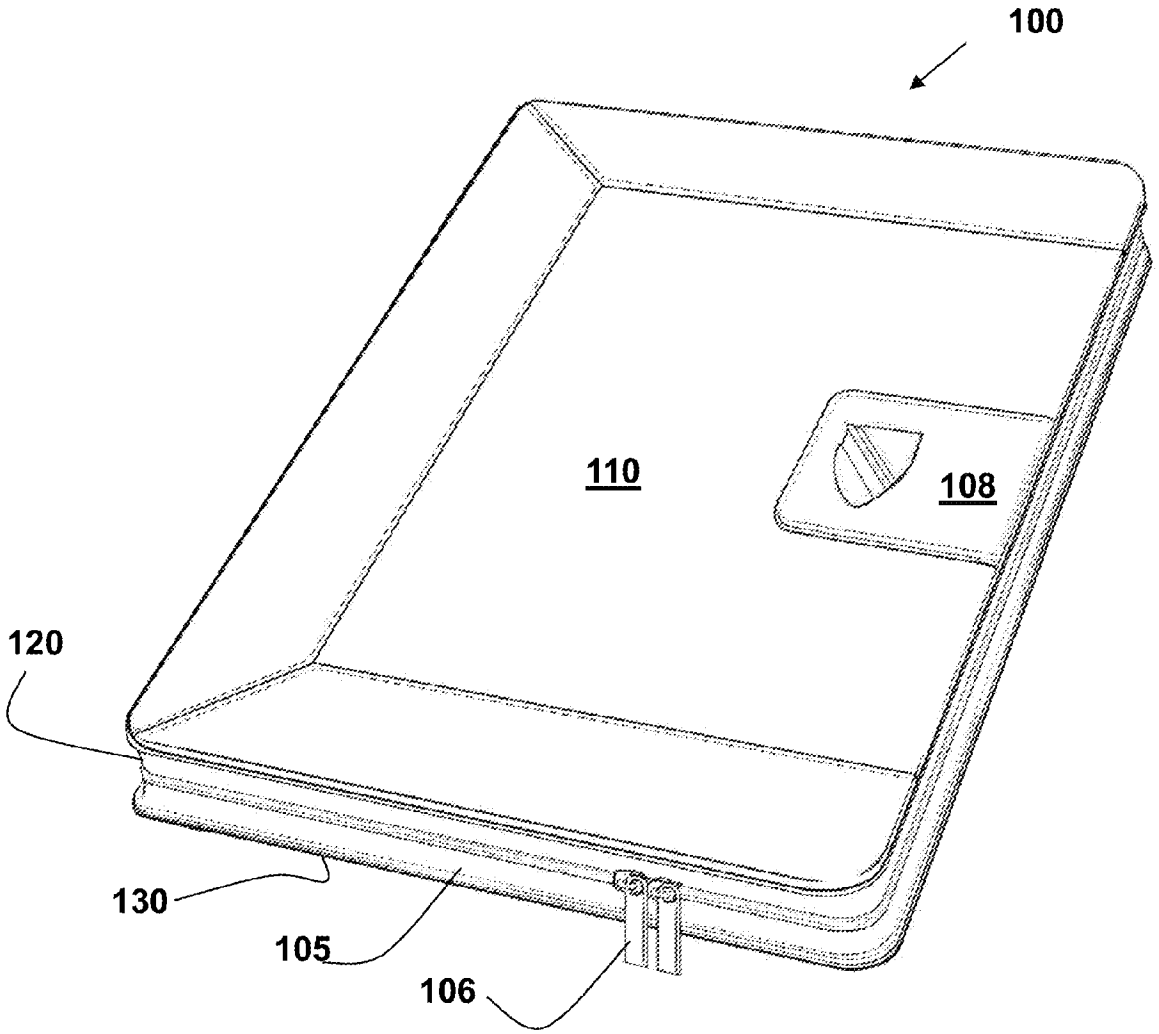
FIG. 20 is a perspective view of the case of FIG. 1, in a closed configuration.

FIG. 20 shows a closed view of case 100, with casing 105 and a zipper closure 106. The appearance of the case 100 may be adjusted as desired, for example by adding decorative emblem or shield 108.

Figure 21:
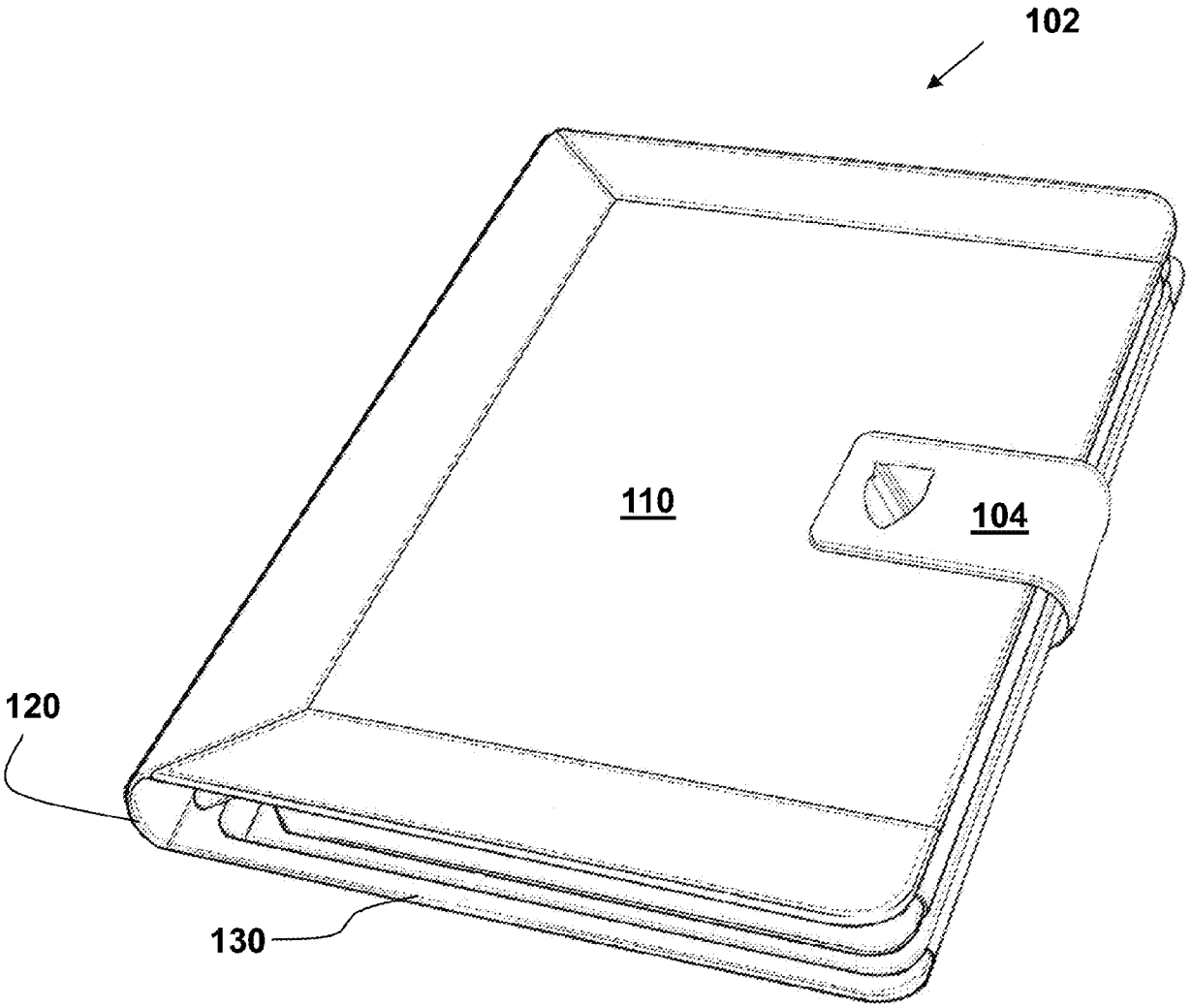
FIG. 21 is a perspective view of the case of FIG. 2, in a closed configuration.

FIG. 21 shows a closed view of case 102. In this case, a closure such as a strap closure 104, snap closure, bungee, etc. may be provided.

The case 100, 102 may be made of a variety of materials, according to manufacturing preference. For example, planar portions of the case, such as covers 110, 130, flaps 132, 150, and support panels 310, 320, may be made of plastic or polymers such as polypropylene, or cardboard, fiberboard, paperboard, and the like. The planar portions may be covered by a fabric or sheet material such as nylon fabric, nylon mesh, cloth, plastic film, and the like. Portions of the case 100, 102 may be made of leather or artificial leather. Closure or fastening materials may include hook and loop fasteners, zippers, snaps, magnets, buttons, buckles, elastic material, and the like.

It will be understood that the illustrated constructions are examples and do not include all possible constructions. It should be understood that additional panels or fold-over panels may be included in the case for further reinforcing the case, providing more storage or additional functionality, and so on.

Having described the invention in detail and with respect to specific advantages thereof it will be apparent that numerous modifications are possible without departing from the spirit and scope of the following claims.

What is claimed is:

1. A storage component comprising:

a cover; and an easel coupled to said cover, the easel including a first portion and a second portion pivotally coupled together, wherein the easel is movable between a substantially flat configuration wherein the first and second portions are generally flat and coplanar, and a propped configuration wherein the first and second portions are arranged in a non-coplanar configuration and the first portion is oriented at an angle relative to said cover, and wherein the first portion of the easel when in the propped configuration is configured to support an item thereon for display, wherein the first and second portions each have at least one edge, and wherein at least part of each edge together define a support plane when the easel is in the propped configuration for supporting the item thereon for display, wherein the support plane is not parallel with said first portion of the easel when in the propped configuration.

2. The storage component of claim 1 wherein when the easel is in the propped configuration the easel is configured to support an item thereon for display against either the first portion in a first position or on the support plane in a second position, wherein the item generally faces a first direction when in the first position and generally faces a second direction when in the second position, wherein the first and second directions are generally perpendicular.

3. The storage component of claim 2 further comprising a biaxial hinge coupled to said easel to enable said item to move between said first position and said second position.

4. The storage component of claim 3 wherein said biaxial hinge enables pivoting about two generally perpendicular axes thereof.

5. The storage component of claim 1 wherein the edge of the first portion and the edge of the second portion define an angle therebetween when in the easel is in said substantially flat configuration.

6. The storage component of claim 5 wherein the edge of the first portion and the edge of the second portion are positioned immediately adjacent to each other.

7. The storage component of claim 1 wherein the first and second portions and said cover are each generally flat and planar.

8. The storage component of claim 1 further comprising a frame, wherein the frame is configured to support the item therein or thereon and be supported by the easel.

9. The storage component of claim 8 wherein the frame is releasably attachable to the easel.

10. The storage component of claim 9 wherein the frame is generally rectangular in top view and has attachment regions proximate to least three corners thereof, wherein the attachment regions are releasably attachable to the easel when the easel is in the substantially flat configuration, and wherein the attachment regions proximate to a maximum of two corners of the frame are releasably attachable to the storage at least one of the easel or cover when the easel is in the propped configuration.

11. The storage component of claim 1 further comprising said item, and wherein said item is an electronic tablet.

12. The storage component of claim 1 wherein said support plane is positioned at a non-perpendicular angle relative to a plane of said cover.

13. A storage component comprising:

a cover;

a supplemental cover pivotally coupled to the cover along a cover fold line; and an easel coupled to said cover, the easel including a first portion and a second portion pivotally coupled together, wherein the easel is movable between a substantially flat configuration wherein the first and second portions are generally flat and coplanar, and a propped configuration wherein the first and second portions are arranged in a non-coplanar configuration and the first portion is oriented at an angle relative to said cover, wherein the first portion of the easel when in the propped configuration is configured to support an item thereon for display and, wherein the first and second portions are pivotally coupled along an easel fold line that is generally perpendicular to the cover fold line.

14. The storage component of claim 13 wherein the first and second portions each have a length extending generally perpendicular to the easel fold line, and wherein the lengths of the first and second portions are equal.

15. A storage component comprising:

a cover; and an easel coupled to said cover, the easel including a first portion and a second portion pivotally coupled together, wherein the easel is movable between a substantially flat configuration wherein the first and second portions are generally flat and coplanar, and a propped configuration wherein the first and second portions are arranged in a non-coplanar configuration and the first portion is oriented at an angle relative to said cover, wherein the first portion of the easel when in the propped configuration is configured to support an item thereon for display, wherein the cover includes a rail coupled thereto and defining a gap thereunder, and wherein the easel includes at least one tab slidably positioned in the gap, and wherein the at least one tab is configured to slide within the gap when the easel is moved between the substantially flat configuration and the propped configuration.

16. The storage component of claim 15 wherein the first and second portions are pivotally attached to each other along an easel fold line, and wherein the at least one tab is slidable in a direction generally perpendicular to said easel fold line.

17. A storage component comprising:

a cover;

an easel coupled to said cover, the easel including a first portion and a second portion pivotally coupled together, wherein the easel is movable between a substantially flat configuration wherein the first and second portions are generally flat and coplanar, and a propped configuration wherein the first and second portions are arranged in a non-coplanar configuration and the first portion is oriented at an angle relative to said cover, and wherein the first portion of the easel when in the propped configuration is configured to support an item thereon for display; and a frame, wherein the frame is configured to support the item therein or thereon and be supported by the easel, wherein the first and second portions have edges, and wherein at least part of the edges define a support plane when the easel is in the propped configuration, wherein the frame is movable between a first position wherein the frame is positioned substantially flat against the first portion, and a second position wherein the frame is positioned on or in the support plane, and wherein said frame is movable between the first position and the second position without entirely detaching the frame from a remainder of said storage component.

18. A method for manipulating a storage component comprising:

accessing a storage component including a cover and an easel coupled to said cover, the easel including a first portion and a second portion pivotally coupled together, wherein the first and second portions each have at least one edge; and moving the easel between a substantially flat configuration wherein the first and second portions are generally flat and coplanar, and a propped configuration wherein the first and second portions are arranged in a non-coplanar configuration and the first portion is oriented at an angle relative to said cover, and wherein the first portion of the easel in the propped configuration is configured to support an item thereon for display, and wherein at least part of each edge together define a support plane when the easel is in the propped configuration for supporting the item thereon for display, wherein the support plane is not parallel with said first portion of the easel in the propped configuration.

19. A storage component comprising:

a cover;

an easel coupled to cover, the easel being movable between a substantially flat configuration and a propped configuration; and a biaxial hinge coupled to said cover, said biaxial hinge being configured to be attached to an item and enable said item to move between a first position in which said item is supported by a first portion of said easel when said easel is in said propped configuration, and a second position in which said item is supported by a second portion of said easel when said easel is in said propped position.

20. The storage component of claim 19 further comprising said item, wherein said biaxial hinge is attached to said item to enable said item to move between said first position and said second position.

21. The storage component of claim 20 wherein said item is generally rectangular, and is oriented in a portrait orientation when in one of said first or second positions, and is oriented in a landscape orientation when in the other one of said first or second positions.

22. The storage component of claim 21 wherein said item is facing a first direction when in said first position, and is facing a second direction that is oriented generally perpendicular to said first direction when in said second position.

* * * * *